US005962075A

United States Patent [19]

Sartor et al.

[11] Patent Number: 5,962,075

[45] **Date of Patent: *Oct. 5, 1999**

[54] METHOD OF MULTILAYER DIE COATING USING VISCOSITY ADJUSTMENT TECHNIQUES

[75] Inventors: Luigi Sartor, Pasadena; Stephen C. Huff, Chino Hills; Craig N. Kishi, Pasadena; Daniel Meyer, Glendora; Jesse C. Ercillo, Covina, all of Calif.

[73] Assignee: Avery Dennison, Pasadena, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/616,859

[22] Filed: Mar. 15, 1996

Related U.S. Application Data

[63] Continuation-in-part of application No. 08/483,509, Jun. 7, 1995, Pat. No. 5,728,430.

[51] Int. Cl.[6] ..... B05D 3/12

[52] U.S. Cl. ..... 427/356; 118/411

[58] Field of Search ..... 427/356; 118/411

[56] References Cited

U.S. PATENT DOCUMENTS

| | | | |
|---|---|---|---|
| 2,681,294 | 6/1954 | Benguin . | |
| 2,761,417 | 9/1956 | Russell et al. . | |
| 2,761,418 | 9/1956 | Russell et al. . | |
| 2,761,419 | 9/1956 | Mercier et al. . | |
| 2,761,791 | 9/1956 | Russell . | |
| 2,901,770 | 9/1959 | Beck . | |
| 2,932,855 | 4/1960 | Bartlett et al. . | |
| 3,005,440 | 10/1961 | Padday . | |
| 3,206,323 | 9/1965 | Miller et al. . | |
| 3,413,143 | 11/1968 | Cameron et al. . | |
| 3,502,494 | 3/1970 | Ishiwata et al. . | |
| 3,508,947 | 4/1970 | Hughes . | |
| 3,526,528 | 9/1970 | Takahashi et al. . | |
| 3,573,965 | 4/1971 | Ishiwata et al. . | |
| 3,584,600 | 6/1971 | Ishiwata et al. | 118/411 |
| 3,627,564 | 12/1971 | Mercier . | |
| 3,916,043 | 10/1975 | Fowble . | |
| 3,928,678 | 12/1975 | Jackson et al. | 427/402 |
| 3,928,679 | 12/1975 | Jackson et al. | 427/402 |
| 4,001,024 | 1/1977 | Dittman et al. | 427/414 |
| 4,113,903 | 9/1978 | Choinski | 427/420 |
| 4,154,879 | 5/1979 | Choinski | 427/402 |
| 4,233,346 | 11/1980 | Kerkhofs | 427/345 |
| 4,348,432 | 9/1982 | Huang | 427/402 |

(List continued on next page.)

FOREIGN PATENT DOCUMENTS

| | | |
|---|---|---|
| 1018838 | 10/1977 | Canada . |
| 2043013 | 2/1971 | France . |
| 61-111168 | 5/1966 | Japan . |
| 71-016830 | 5/1971 | Japan . |
| 1029017 | 5/1966 | United Kingdom . |
| 1219225 | 1/1971 | United Kingdom . |
| 2031301 | 4/1980 | United Kingdom . |
| 2120132 | 11/1983 | United Kingdom . |

OTHER PUBLICATIONS

Denis Cohen, "Two–Layer Slot Coating: Flow Visualization and Modelling" ( No date).

Denis Cohen, "Design Optimization and Comparison of Permetered Coating Methods"(No date).

David J. Conlon, "Two–Slot Coater Analysis: Inner Layers Separation Issues in Two–Layer Coating" (No date).

*Primary Examiner*—Katherine A. Bareford

*Attorney, Agent, or Firm*—Knobbe, Martens, Olson & Bear, LLP

[57] ABSTRACT

A method for simultaneously coating multiple thin layers of relatively viscous fluids comprises the relative adjustment of the viscosity of the fluids in order to achieve a viscosity ratio in the optimum range without adversely affecting the adhesive properties of the fluids. In the preferrred method, viscosity is adjusted by varying the temperature of one or both fluids prior to coating and/or by reformulating the liquids to vary their relative viscosities.

33 Claims, 9 Drawing Sheets

U.S. PATENT DOCUMENTS

| | | | |
|---|---|---|---|
| 4,375,498 | 3/1983 | Le Minez et al. | 428/416 |
| 4,384,015 | 5/1983 | Koepke et al. | 427/402 |
| 4,440,811 | 4/1984 | Hitaka et al. | 427/402 |
| 4,445,458 | 5/1984 | O'Brien | 118/401 |
| 4,476,165 | 10/1984 | McIntyre | 427/258 |
| 4,479,987 | 10/1984 | Koepke et al. | 427/402 |
| 4,489,671 | 12/1984 | Choinski | 118/412 |
| 4,569,863 | 2/1986 | Koepke et al. | 427/402 |
| 4,572,849 | 2/1986 | Koepke et al. | 427/402 |
| 4,647,475 | 3/1987 | Inukai et al. . | |
| 4,835,021 | 5/1989 | Fronheiser | 427/393.5 |
| 4,842,900 | 6/1989 | Miyamoto | 427/348 |
| 4,844,946 | 7/1989 | Komatsu et al. | 427/130 |
| 4,854,262 | 8/1989 | Chino et al. | 118/411 |
| 4,863,765 | 9/1989 | Ishizuka | 427/420 |
| 4,874,633 | 10/1989 | Komatsu et al. | 427/131 |
| 4,877,639 | 10/1989 | Willemsens et al. | 427/13 |
| 4,927,665 | 5/1990 | Chino et al. | 427/131 |
| 4,976,999 | 12/1990 | Ishizuka | 427/420 |
| 4,977,852 | 12/1990 | Ishizuka | 118/411 |
| 4,994,306 | 2/1991 | Takahashi et al. | 427/131 |
| 5,030,484 | 7/1991 | Chino et al. | 427/131 |
| 5,069,934 | 12/1991 | Chino et al. | 42/131 |
| 5,072,688 | 12/1991 | Chino et al. | 118/411 |
| 5,112,424 | 5/1992 | Cook | 156/243 |
| 5,256,357 | 10/1993 | Hayward | 264/171 |
| 5,558,913 | 9/1996 | Sasaki et al. | 428/41.5 |

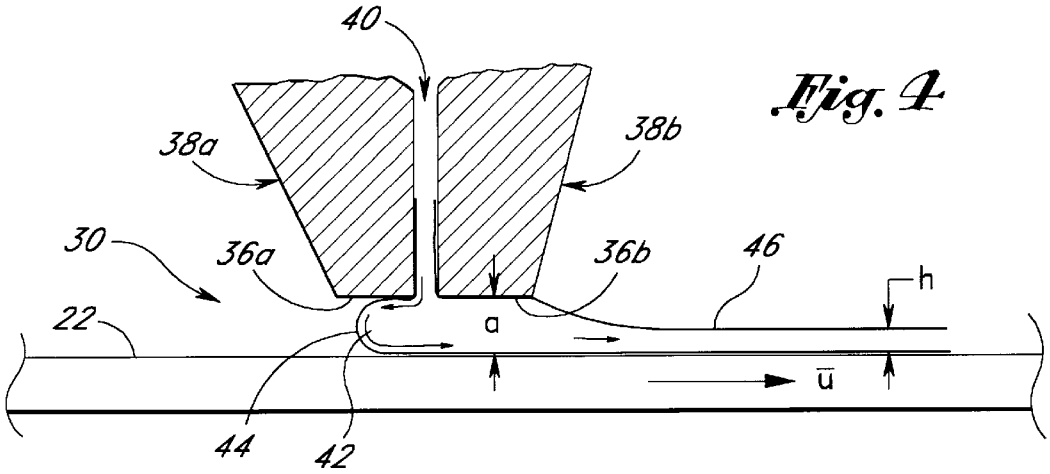
Fig. 4
Fig. 5a
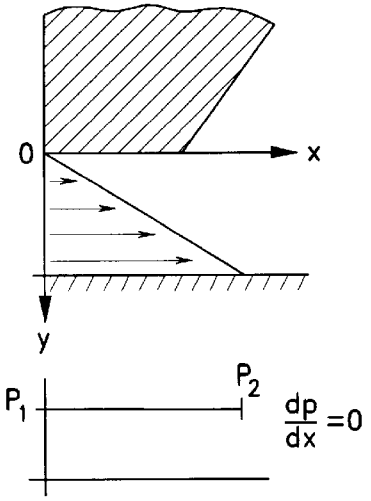
Fig. 5b
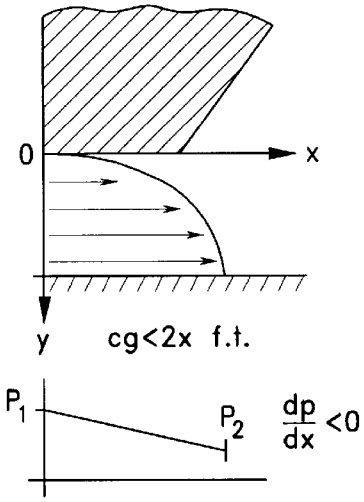
Fig. 5c
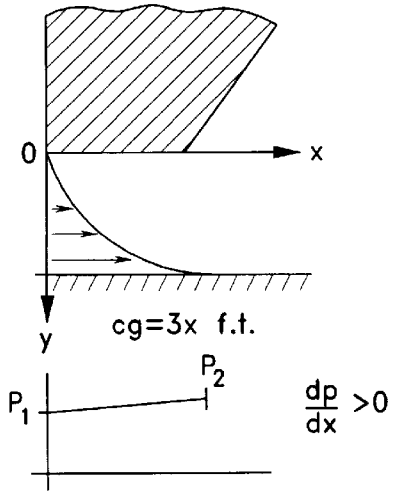
Fig. 5d
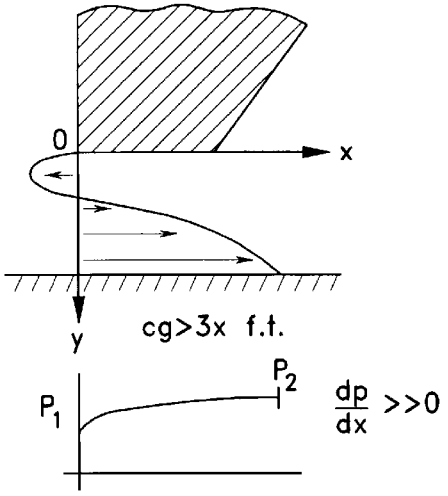

METHOD OF MULTILAYER DIE COATING USING VISCOSITY ADJUSTMENT TECHNIQUES

CROSS-REFEERNCE TO RELATED APPLICATION

This is a continuation-in-part application of application Ser. No. 08/483,509, filed Jun. 7, 1995 , now U.S. Pat. No. 5,728,430.

FIELD OF THE INVENTION

The present invention relates to a method of die coating, and, more particularly, to a method for multilayer die coating in which the viscosity of the liquids which form said layers can be adjusted by a variety of techniques, including temperature differential and/or reformulation, in order to enhance the coating quality.

BACKGROUND OF THE INVENTION

There is a tremendous demand for sheets or other substrates having coated thereon thin layers or "films" of liquids, in particular, polymeric liquids such as pressure-sensitive adhesives (PSAs). Such PSA liquids fall into at least three categories, including emulsions, hot melts, and solvent-based solutions; however, there are numerous types of PSAs within these and other categories exhibiting a wide variety of fluid characteristics. There are also numerous other kinds of liquids which require coating onto some type of substrate.

Typically, such a substrate with the thin film coating thereon is formed into rolled materials, which then undergo a "converting" process wherein they may be printed, die cut, and otherwise formed into a wide variety of end products, including labels, identification systems, tapes, etc. These rolled, coated materials often exhibit a sandwich construction, meaning that the substrate is coated with multiple layers of liquid PSA adhesives or other liquids which then receive a top sheet comprising some type of facestock. There is almost an endless variety of such multilayer products made up of numerous different kinds of backing sheets, coatings, and facestocks.

At present, in the production of such multilayer products, each layer is typically coated individually in a single pass through a coating device. The coating may be applied to any type of substrate, including a release liner or even to the facestock. The coating is then typically oven dried or solidified by cooling in the case of hot melt PSAs. If additional layers of coatings are to be applied thereon, the rolled material, having previous coating layers applied thereto, undergoes another coating operation. Ultimately, it is common for a backing and a facestock, each having any number of layers applied thereto, to be laminated together to form the final multilayer product. A number of coating techniques may be utilized; however, interference coating or proximity coating is commonly used for the single-layer coating of the type described. In either case, the liquid to be coated in a single layer on the substrate is fed past an elongated slot formed in a die (thus, this technique is also sometimes referred to as "slot coating"). The slot is positioned at approximately a right angle to the direction of travel of the rolled substrate, which is usually referred to as a "web." The die is stationary, but the head of the die, comprising two "lips" which define the opening of the slot, are placed adjacent to the web. The web travels around a back-up roll as it passes in front of the lips. The slot formed by the lips and the web have substantially equal widths, such that the entire cross web width of the web is coated in one pass by the fluid as it flows out of the die and onto the moving web.

If properly designed and adjusted, the die will distribute the liquid evenly and uniformly across the web in a thin layer. Typically, the die can be adjusted radially to move toward or away from the web, thus determining the gap between the lips and the web, also referred to as the "coating gap." In addition, the angle of the lip surfaces with respect to the web, or "angle of attack," can also be adjusted. For a given coating thickness, the flow parameters of the liquid can be determined, including the flow rate. Once these parameters are determined and the die is "set" in the coating machine, usually only the coating gap and angle of attack are adjusted during operation. However, because of the extremely thin layers being coated, any such adjustments usually inject a certain degree of imprecision into the process.

For example, it is common for such single-layer coatings to be in the range of 2–50 microns. Moreover, the difficulty in accurately coating such layers is increased by their relatively high viscosity, usually in the range of 50–50,000 millipascal-seconds (mPa-sec). In addition, the pressures and shear rates experienced during coating often will vary by several orders of magnitude. For example, some types of PSA liquids experience pressures in the range of 900 psi. The die must be able to coat liquids having these parameters at relatively high production rates, e.g., web speeds in the range of 50–350 meters per minute or higher.

There are also physical limitations on the accuracy of the die itself. For example, it is very difficult to hold extremely small tolerances on the lip geometries of the die, especially over the width of the slot which may vary between a few and a hundred or more inches. Thus, in order to achieve as much precision as possible, in the case of interference coating the lips of the die are actually pressed forward into the web which is supported by a back-up roll typically constructed from a hard rubber material, which in turn deforms in response to the forward pressure of the die. The downstream lip and most of the upstream lip do not contact the web because they hydroplane on a thin layer of liquid, although in some cases a portion of the upstream lip can contact the web. Thus, such deformation compensates for any imprecision in the configuration of the die lips. On the other hand, this technique has the disadvantage of increasing the rate of wear of the die lips (especially the upstream lip), further injecting inaccuracies into the process. Moreover, under these circumstances, any imperfections in the roll (e.g. eccentricities or "roll runout") will be magnified. Another disadvantage of interference coating is that the passage of a splice in the web may be difficult.

In another type of coating, proximity coating, the lips of the die are set back a precise distance away from the web. The back-up roll is typically constructed from a stainless steel material which allows for precision in the circumferential shape of the roll. Thus, unlike interference coating, the back-up roll in proximity coating is less likely to exhibit eccentricities (also referred to as "roll run-out") as it rotates.

To further achieve precise single-layer coating, a number of techniques have been developed. For example, it is well known that the configuration of the lips can be adjusted with respect to the web in order to improve coating accuracy and uniformity. Also, it is well known to angle or cant the downstream lip of the die so that it is somewhat convergent with respect to the web. This has the advantage of providing a smooth surface for the coating and avoids "ribbing" and other defects in the coating. This lip convergence is typically accomplished by adjusting the angle of attack of the die so that the lips are angled to face the oncoming web (defined herein as negative degrees of angle of attack).

However, adjustments in the angle of attack of the die affect the fluid mechanics of the overall "bead" of liquid. The bead is defined as that portion of the liquid captured between the die lips and the web, along the two longitudinal sides, and between the two ends of the bead defined as the upstream meniscus and the downstream meniscus or film-forming region. Thus, if the convergence is too large, the flow sees a large pressure gradient which has a tendency to force the liquid upstream. If the bead advances in the upstream direction, it is likely to explode, since the pressure gradient varies quadratically in this region. This results in "upstream leakage" of the liquid, obviously resulting in poor coating performance. Therefore, another single-layer coating technique is to position the upstream lip so as to increase the pressure drop along this die lip. This has the effect of ensuring that the bead remains under the lips or is "sealed."

Another disadvantage of such larger pressure gradients is the resulting shear rate experienced by the liquid. In single layer coating where viscosity is determined only by the properties of one liquid, the negative side effects of such high shear rate are limited to poor film quality whenever the high shear stresses redistribute the film in the cross-web direction, or when they cause material breakdown in shear sensitive liquids. Additionally, for multilayer coating, where viscosity may vary due to the existence of multiple liquids, although not completely understood, it is observed that this high shear rate (or even a lower shear rate experienced over a given period of time) causes the fluid to vary from a stable, two-dimensional flow to take on a three-dimensional flow profile. In other words, the flow, in the face of shear stresses, attempts to rearrange itself into a three-dimensional pattern in order to reduce the resistance to flow. As a result of this three-dimensional flow, the liquid undergoes a certain amount of convective mixing in between the layers.

There are other sources of imprecision in single-layer coating. For example, it may be difficult to correctly control the viscosity of the liquid or the velocity of the web. The web itself may be a relatively uneven or irregular surface, thus increasing the difficulty in applying a uniform coating thickness thereto. Foreign particles or other materials may be deposited onto the web or entrained into the liquid. Moreover, even slight variations in ambient pressure can affect coating accuracy. Any one of these events can result in a "perturbation" or variation from steady-state coating.

Notwithstanding the foregoing difficulties, good results can usually be obtained with present single-layer coating techniques. The process can be quite forgiving. That is, perturbations or other instabilities often do not have a substantial effect on the performance of the end product. In addition, if the flow is stable, the effect of a perturbation is likely to dampen out very quickly, thus minimizing the severity of the defect.

However, there is an ever-present need to reduce production costs and to develop higher quality products. In the single-layer coating process described above, a number of coating, drying, and laminating steps must occur to produce a final multilayer product. Thus, the costs of machinery and labor are relatively high. Also, it has been found that the mechanical and rheological properties of certain multilayer products may be different depending on whether the layers are coated individually or simultaneously. That is, if two wet layers are applied simultaneously to a substrate, it has been found that the end multilayer product may have improved convertibility and performance. However, in order to coat two or more layers simultaneously, the die must have two or more slots instead of one. Thus, in addition to an upstream lip and a downstream lip (which are used for single-layer coating), a multilayer die must also have intermediate or "middle" lips in order to define the appropriate number of slots or feed gaps.

Such "dual" dies, however, have not yielded successful multilayer coatings. This is because the principles of single-layer coating do not translate well into multilayer coating. The fluid mechanics of two or more wet layers simultaneously applied to each other are very different than those experienced in a single layer. On the other hand, in certain industries, such as the photographic film industry, multilayer coating has been successfully utilized in a number of coating techniques, including slide coating, combination die/slide coating, or straight die coating. However, the liquid requirements of that industry are quite different from the PSA industry where highly viscous liquids are prevalent.

Furthermore, in the PSA industry, high performance products for specific applications are frequently required. Thus, the adhesives used in these applications may be specially designed individually and strategically combined as a pair into the multilayer product. This situation may present a severe challenge to the coating expert since the product is engineered for its performance characteristics or the properties of the adhesive, and not for its coatability.

Thus, there is a need in the prior art for a method of multilayer die coating utilizing a wide variety of liquids wherein the coatability of certain combinations of viscous adhesives can be adjusted or otherwise improved while maintaining the important properties of the adhesives.

SUMMARY OF THE INVENTION

The method of the present invention fills the need in the prior art by providing a method of multilayer coating in which the viscosity of the adhesives being coated can be adjusted so as to improve their coatability. In the preferred method, this adjustment is accomplished through the maintenance of differential temperatures of the adhesives during the coating process. Thus, it has been found that this viscosity adjustment improves coatability and reduces defects, while at the same time maintaining the desirable characteristics of the adhesives.

The present method can be utilized in the context of a method of multilayer coating that has been shown to produce good results, the various steps of which include an analysis of certain liquid parameters of the coating, the particular and precise design of the die lip geometries, and the assembly or setup of the die with respect to the moving web. Following these steps, a number of experimental coatings can be performed in order to determine an operating window for achieving successful multilayer coating. Even within this window, a higher quality window can be determined for full production coating operation. These steps assist in providing a stable, two-dimensional flow.

An unstable flow changes its profile with respect to time. This can result in random fluctuations or regular oscillations in the flow profile, thus causing irregularities in the cross-sectional film configuration. In addition, slight perturbations in the coating process under unstable conditions may propagate, rather than dampen out quickly to a steady state condition as with stable flow. Likewise, a three-dimensional flow would result in the mixing of the two layers, or would result in cross-web, nonuniform layer thickness, as well as other defects such as non-continuous layers or voids, etc. In stable, two-dimensional flow each layer has greater uniformity, thus resulting in a product of higher integrity and performance. Furthermore, if the flow is perturbed, this type of flow will return to its steady, two-dimensional flow characteristics rapidly, thus minimizing any defects in the product. Thus, the present method ensures stable, two-dimensional flow at the separating line.

This is achieved in the coating method of the present invention by controlling the interface of the flow at its upstream most position, which is referred to herein as the separating streamline or separating line. This line is defined, in the sense of web travel, as the cross-web line where the topmost streamline of the bottom flow layer first meets the bottommost streamline of the top flow layer. In the opposite direction, the separating line can be viewed as the location where the two flows separate from the die lips. Although the separating line runs completely across the web, when the die/web interface is shown from the side, it appears as a point. As noted, this separating line will occur in the region of the mouth of the downstream slot or feed gap where the flows of the bottom layer and top layer are confluent. For ease of reference, this region will be referred to herein as the "interface region." It will be understood that if the combined flow of the two layers is stable and two-dimensional in this interface region, and more particularly at the separating line, it is likely to retain such flow characteristics throughout the coating process, thus resulting in an improved end product.

In order to achieve such advantageous flow characteristics at the separating line, the multilayer coating method of the present invention assists in positioning that line at the downstream corner of die middle lip. This corner presents a straight, two-dimensional line across the die. Thus, if the separating line is coincident at this corner, one will be assured of achieving stable, two-dimensional flow. For this reason, this corner is referred to herein as the "stability point." On the other hand, it will be appreciated that unstable or three-dimensional flow conditions can cause the separating line to occur at several locations in the interface region. For example, "recirculations" in the bottom layer flow can cause the top layer flow to be pulled upstream such that it separates from a position underneath the middle lip. Likewise, vortices or other stagnant flow in the top layer can cause the top layer to separate from the middle lip at a position within the feed gap of that flow.

Stable, two-dimensional flow characteristics in the interface region are achieved in the present invention due in part to a method of regulating the pressure gradient such that the separating line is positioned at the stability point. In accordance with one method of the present invention, the pressure gradient can be regulated by designing and assembling a die having a particular middle lip geometry. This method of pressure regulation helps to pin or lock the separating line at the stability point. This is achieved, as the name implies, by regulating the pressure gradient in the interface region. As is well understood, the pressure gradient in this region is highly dependent on the coating gap and its relationship to the downstream film thickness. In accordance with complex but well understood principles of fluid mechanics, the pressure gradient created at a particular longitudinal portion in the bead is related to the coating gap at that point and the downstream thickness of that flow. Here, however, much care must be taken in the analysis. Indeed, for a single-layer coating the analysis is more direct, since there is only one flow, and one downstream film thickness. However, for a multilayer coating process, there are two or more flows. Thus, in a method for regulating the pressure gradient at a given point in the flow, the coating gap at that point and the downstream film thickness of the layer(s) formed by that flow must be analyzed in order to achieve proper lip design and positioning parameters.

Therefore, an analysis of the pressure gradient within a particular flow, and particularly the pressure gradient of the combined flow at the interface region, is quite complex.

The method of the present invention designs the middle and downstream die lip geometries such that the pressure gradients in the flow fix the separating line at the stability point. In another aspect of the present method, the middle lip is extended toward the web. Therefore, the profile formed by the design of the middle and downstream lips of the die represent a step away from the web in the direction of web travel. This step configuration may be flat or parallel with respect to the web or angled with respect thereto. It may even exhibit other designs. It is only important that certain pressure gradients be maintained in the interface region, and particularly along the middle coating gap from the stability point toward the upstream corner of the middle lip. Thus, the magnitude of the step may be in the range of 0–0.004 inches. For flat lip designs (e.g., no angle or bevel formed on the lips), the middle and downstream lips fall into parallel planes. However, for beveled or other lip designs, the planes of the two lips may be intersecting.

It will be understood that this stepped design of the die lips affect the coating gap under both the middle and downstream lips in the interface region. Since the middle lip is stepped toward the web, the coating gap under this lip will be less than that under the downstream lip. As a result, if the die is correctly positioned with respect to the web, the pressure gradient under the middle lip will be approximately zero, while the pressure gradient under the downstream lip will be negative. Again, this relationship exists at least in the interface region close to the mouth of the downstream feed gap. Due to other lip designs (such as bevels) and adjustments in the angle of attack of the die, the relationship between the pressure gradients under the middle lip and under the downstream lip may vary differently. However, in the interface region it is important that the pressure gradient at or just upstream of that region not be excessively positive in the direction of web travel.

If the pressure gradient is too high in this region, certain instabilities in the flow would occur, thus resulting in coating defects. For example, in the absence of proper pressure gradient regulation, the bottom layer flow may exhibit "recirculation" under the middle lip. This could occur, for example, if the downward step in the middle lip were not existent, thus resulting in a larger coating gap in this region. A larger coating gap results in a highly positive pressure gradient in the bottom layer flow, causing it to actually flow upstream a short distance before turning around and flowing downstream. Such velocity characteristics are referred to as "recirculation" of the flow. One of the most serious disadvantages of such recirculations in the bottom layer flow is its tendency to pull the top layer flow upstream under the middle lip and away from the stability point. Thus, the separating line moves upstream and there is no assurance that the line will be formed in a straight and steady manner. Thus, mixing and diffusion between the two layers at their interface may increase. In addition, the flow may be mottled or blotchy. Other defects can be caused by recirculations. Recirculations are of two types: open loop and closed loop. Open-loop recirculations are less damaging because any liquid entering them leaves after a short period of time (low "residence time"), before continuing to flow downstream.

Closed-loop recirculations, however, result in high residence time because the liquid is trapped in them. Moreover, all recirculations are known to prefer three-dimensional flow characteristics. For higher temperature liquids such as hot melt PSAs, this may result in degradation, then charring, and then streaking. For PSA emulsions, the prolonged shear deformation may cause the emulsion to break down, and formation of particulate leading again to streaking.

On the other hand, the pressure gradient under the middle lip cannot be too large (which might occur, for example, if the coating gap in this region were too small). Such a large pressure gradient is likely to result in upstream leakage of the fluid. Also, as mentioned above, such high pressure gradients can result in high shear stresses with other deleterious effects on the performance of the coating.

It will also be observed that the step designed into the middle lip can be achieved by positioning that lip at the proper coating gap and moving the downstream lip further away from the web. However, there is also a tradeoff in this parameter. If the coating gap under the downstream lip then becomes too large, recirculations or vortices in the top layer flow may result. One additional type of defect that may occur is known as "chatter", or a two-dimensional oscillation of the bead.

Thus, an important advantage of the method of the present invention is that it provides a proper pressure gradient ahead of the interface region. However, as explained, this advantage can only be achieved when the die is correctly set with respect to the web in order to exhibit proper coating gap characteristics. Preferably, it has been found that the die should be set such that the coating gap under the middle lip (especially in the interface region) is approximately two times the bottom layer wet film thickness downstream of the die (before drying). It should be re-emphasized that this thickness, however, is the thickness of the bottom layer only which is being coated from this particular flow under the middle layer. On the other hand, the coating gap under the downstream lip (particularly in the interface region) should be greater than one time but not greater than two times the wet film thickness downstream. In this latter case, this thickness is the combined thickness of both layers as well as any previous layers. Thus, it will be understood that these principles apply to multilayer coating of any number of layers, with the terms "bottom layer" and "top layer" referring to any two adjacent layers. It will also be recognized that these relationships will slightly vary due to non-Newtonian characteristics of the liquid,as well as other variables.

On the other hand, the method of the present invention allows for optimization of the multilayer coating process. In one aspect of the method, the middle and downstream lips are flat or parallel with respect to each other. Thus, any convergence of the downstream lip can be achieved by adjusting the angle of attack of the die. In another aspect of the method, however, the optimization of the coating process is facilitated by beveling the downstream lip so that it exhibits some convergence, even without any angle of attack adjustment. With this improvement the "operating window" of the die can be increased. This means that successful coating can be achieved, even if certain coating parameters cannot be accurately controlled. On the other hand, a larger operating window increases the chance of a larger quality window where the best coating occurs. Moreover, a large operating window allows a technician of less skill or experience to successfully perform the coating operation. In addition, a wider variety of products comprised of a broader range of liquids can be produced, even single-layer products.

In another aspect of the present invention, the upstream lip is also designed so that it steps toward the web with respect to the middle lip. This also achieves an increasing pressure gradient in the upstream direction and assists in sealing the bead under the die lips to avoid upstream leakage. There is always recirculation in the bottom layer under the upstream lip. However, typically, such recirculation is open so that it does not negatively affect the quality of the bottom layer. This upstream lip can be "flat" or parallel to the web, or it may be beveled or angled with respect thereto. Preferably, the bevel represents a divergence in the sense of the web travel. This profile presents a positive pressure gradient in the upstream direction, which further assists in sealing the bead.

When the upstream and downstream lips of the present method are beveled, the middle lip is preferably maintained close to flat (in the sense that it is approximately parallel to the web, not taking into consideration any curvature). This can be achieved, even during operation, since angle of attack adjustments are minimized due to the beveling of the aforementioned lips. The flatness of the middle lip, together with an appropriate coating gap, provides a zero pressure gradient to the flow, which advantageously avoids recirculations and still reduces shear rate and shear stresses, as discussed above. A flat middle lip also has the advantage of reducing the risk of upstream leakage. Moreover, this middle lip is the most expensive to manufacture, and the absence of a bevel assists in reducing costs.

It should be noted that other lip geometries are possible in order to achieve the advantages of the present invention. Also, other methods of pressure regulation are possible.

In another aspect of the present invention, pressure gradient regulation can also be achieved with lip designs of a particular length, especially that of the middle and downstream lips. That is, it will be appreciated that the length of the die lips will affect the coating gap if the angle of attack of the die is adjusted. Typically, with a negative angle of attack (a convergence of the die lips with the web in the downstream direction), the coating gap at the upstream portion of each lip is greater than at the downstream portion of each lip. This is especially true, considering the curvature of the back-up roll. As noted above, if coating gaps are too great, recirculations will occur due to inappropriate pressure gradients, thus causing the loss of control of separating line position and poor coating quality.

In addition, as noted above, the flow experiences shear stresses in the bead due primarily to the rapidly moving web. Even if the shear rate is tolerable with respect to fluid properties, the duration of the shear can have damaging effects on liquid quality. The longer the lips, the greater the duration of the shear stresses experienced by the liquid. Thus, it is important when designing the die lip geometries, to consider the length of the die lips for coating gap, as well as shear stress considerations.

Therefore, it is an important aspect of the present method that the lip lengths are minimized, while providing sufficient length to develop stable rectilinear flow. Perhaps the most important die lip length is the downstream lip. This lip must be long enough for the flow to develop. Such lip may be in the range of 0.1–3 millimeters in length, with about 0.8–1.2 millimeters being preferable. The middle lip also may range from 0.1–3 millimeters, but is preferably about 0.3–0.7 millimeters in length. The upper lip, on the other hand, can be longer without suffering shear stresses in the liquid because the length of travel is reduced. Moreover, a longer upstream lip assists in sealing the bead. Thus, a lip in the range of 1–3 millimeters is advantageous, with 1.5–2.5 millimeters being preferable.

Thus, the present method of multilayer coating has a downstream feed gap region characterized by a pressure gradient which generates stable flow at the interface between a bottom layer (including any previously coated layers) and a top layer. This pressure gradient is achieved by a combination of middle lip and downstream lip geometries, which result in an adequate pressure gradient at the interface region which is not so positive as to cause recirculations.

In addition to the correct design of the die lip geometries and the assembly and setup of the die with respect to the web so that correct coating gaps are achieved, the present method also involves a careful analysis of certain fluid parameters with respect to the liquids to be coated on the web. In particular, the present method involves an analysis of the relative viscosities of the two liquids. Preferably, the viscosity of the top layer liquid should be greater than the viscosity of the bottom layer liquid. More specifically, a top layer viscosity which is about 30% greater than the bottom layer viscosity is optimal; however, successful multilayer coating can be achieved when the top layer viscosity ranges from about 50% less to 100% (or even more) more than the viscosity of the bottom layer. In this case, "top layer" refers to that layer of adhesive formed from the flow of liquid which is contiguous with the "bottom layer," which is the layer of adhesive formed from the flow adjacent to and therefore contiguous with the web.

However, it will be recognized by those of ordinary skill that liquid parameters within these ranges may not always be maintainable for a variety of reasons. For example, in order to achieve certain product characteristics, the top layer may have a viscosity which is substantially lower than that of the bottom layer. Furthermore, it may be impractical or expensive to modify the viscosity of the one or more of the adhesives, or the desirable adhesive properties may be lost if viscosity is varied too much. Thus, it may be not be possible to coat a particular product under ideal coating conditions or even close to ideal conditions, at least as far as adhesive viscosity is concerned.

Thus, an important advantage of the present method is the provision of a differential temperature technique for making certain adjustments in viscosity without affecting the adhesive properties of the materials. According to this technique, the temperature of one or both of the adhesives can be varied within limits in order to adjust the viscosity ratio of the materials, thus allowing the coating to occur more toward the ideal point in the viscosity ratio range. In the preferred method, this technique is applied to rubber-based hot melt adhesives, which are typically coated at a desired temperature or "set point" in current single layer techniques; however, the temperature of each adhesive must be individually adjustable in order to achieve the viscosity matching or balancing advantages of the present invention. Thus, in one "inverse" coating example (e.g. the top layer has a viscosity which is less than that of the bottom layer), improved coatability can be achieved by decreasing the temperature of the top layer in order to increase its viscosity. However, the temperature cannot be increased so high as to result in any thermal degradation of the polymeric properties of the material, or decreased to such an extent to cause phase separation of the mixture. Nevertheless, with appropriate limits, the increased viscosity can be sufficient to better match that of the bottom layer, and thereby eliminate certain coating defects, such as, for example, "banding." Banding is a defect in which ther are areas which lack one of the layers, which areas extend for a width of about 0.5 cm or more across the web and are invariant with respect to the machine direction.

This balancing of viscosities is important in order to assist the process in achieving steady, two-dimensional flow. However, because the flow experiences such high shear rates, the viscosity analysis must take into consideration the change in viscosity due to such shear rates. Thus, for example, due to shear thinning, the viscosity of any liquid being coated may vary by several orders of magnitude of milliPascal-seconds (mPa-sec). At the same time, the shear rate may vary by four or more orders of magnitude with respect to the film coating parameters involved with the present method. In particular, shear rates above 1,000 reciprocal seconds (1/sec) are likely to be experienced under such coating conditions. Accordingly, the relative viscosities of the liquids being coated should be compared at these higher shear rates.

In addition, the surface tensions of the respective liquids should be analyzed, with the top liquid preferably having a lower surface tension than the bottom liquid. This condition helps to avoid the formation of voids in the top layer with respect to the bottom layer which may be formed by de-wetting phenomena.

Once the lip geometries have been designed and set with respect to the die, and the liquid parameters analyzed, another important aspect of the present invention is the experimental determination of the area of operating parameters in which successful coating can be achieved. This area is often referred to as the "coating window" and may be defined in terms of a graph of coating gap versus angle of attack of the die. Thus, in order to determine a coating window, samples of the two liquids are experimentally coated at varying coating gaps and angles of attack and the coating quality is observed. The area where adequate coating is achieved is noted, including the area where very high quality coating is achieved (usually a subset of the overall coating window). It is preferable that the coating window be as large as possible so that inaccuracies in coating gap and/or angle of attack do not result in coating defects or product degradation. In order to add another dimension to the coating window, the same liquids being tested are also tested at various viscosities.

Once the coating window is determined, production coating may occur preferably at a point in the middle of the range of the angles of attack and close to the maximum coating gap and angle of attack.

In summary, the method of the present invention enhances the optimization of the multilayer coating process by providing for the adjustment of viscosity ratios in the adhesive layers, preferably through temperature differential.

BRIEF DESCRIPTION OF THE DRAWINGS

FIG. 4 is a close-up cross-sectional view of a coating gap formed between a single layer die and a moving web illustrating certain principles of fluid mechanics utilized in the present method.

FIGS. 5*a*, 5*b*, 5*c*, and 5*d* are schematic illustrations of the velocity profiles formed within the coating gap illustrated in FIG. 4 under certain coating conditions.

DETAILED DESCRIPTION OF THE PREFERRED METHOD

Before describing in detail the various steps of the methods of the present invention, it will be noted that the method is not limited to the coating of two layers, but further comprises the coating of any number of a plurality of layers, including the simultaneous coating of a single liquid in multiple layers. Thus, the drawings and descriptions thereof should not be considered limiting with respect to the scope of the method of the present invention; moreover, such method should not be limited to any particular sequence with respect to its steps, except where expressly noted.

Thus, in one aspect of the method, a uniformly layered film in the cross-web direction is achieved by the careful analysis of the viscosities and other physical parameters of the liquids to be coated onto the web to form a multilayered product. This uniformity results in a high quality product. In addition to this analysis, the present method involves the design of the die lips and their placement relative to the web in accordance with important principles of fluid mechanics, in order to regulate the pressure gradients of flow during operation. These steps of die lip design and die set-up result in the control of the separating line of two contiguous liquid layers at the stability point and the assurance of steady, two-dimensional flow. In order to ensure successful operation, a coating window (including a quality window) can be determined and an optimal operating point determined.

Each of these aspects of the present method will be discussed separately herein; however, the following overview of die coating techniques is provided as background information.

Overview of Die Coating

Figure 1:
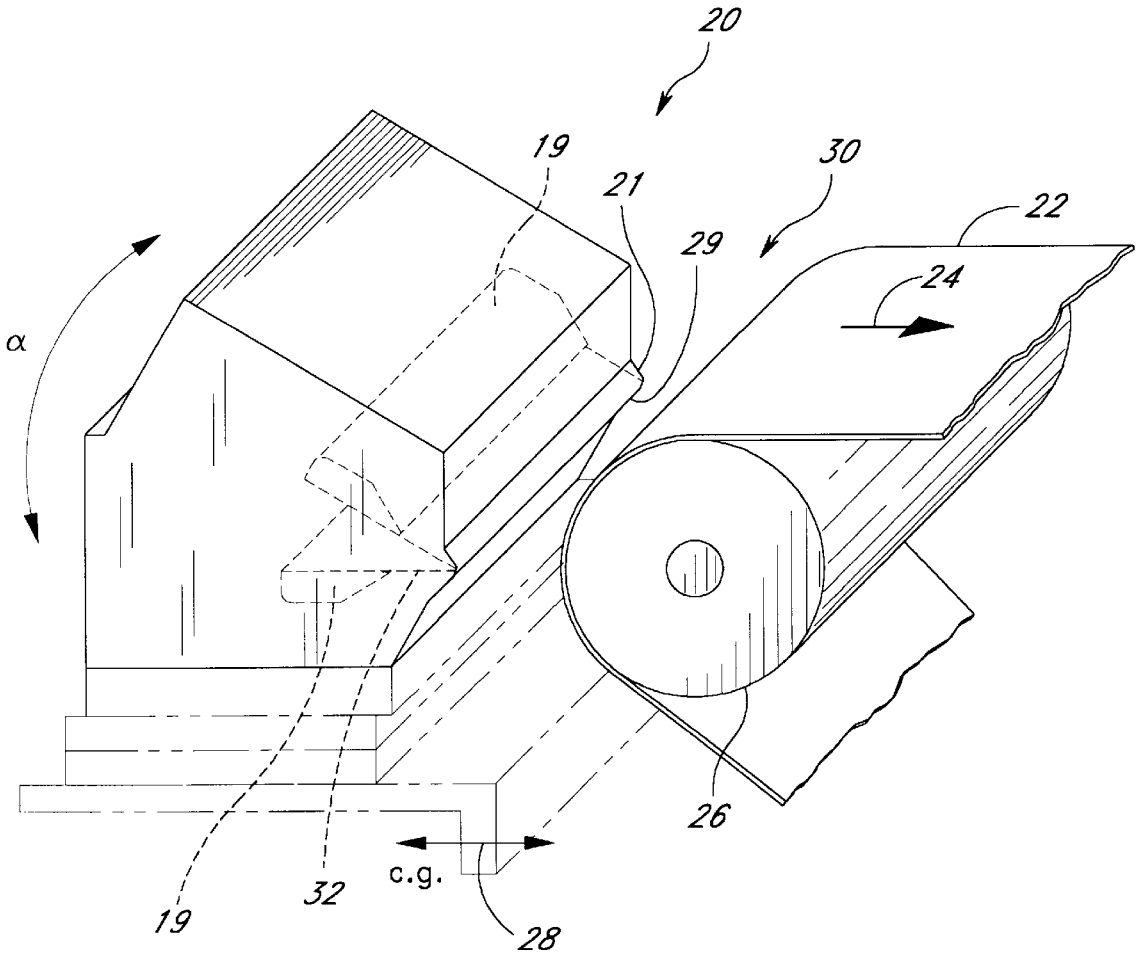
FIG. 1 is a perspective view of a multilayer die which may be utilized in the present method, the die being positioned adjacent to a moving web traveling around a back-up roll.

Referring to FIG. 1, there is illustrated somewhat schematically a typical die coating operation. The die 20 is shown positioned adjacent to a moving substrate or web 22 traveling in the direction of arrow 24. The web 22 travels around a back-up roll 26 as it passes across the distal end of the multilayer die 20. As shown in FIG. 1, it will be understood that both the die 20 and the web 22 have substantially equal widths, such that most of the entire width of the substrate or web is coated in one pass by the fluid flowing out of the die and onto the web.

The die 20 is modular in that it can be assembled from a number of individual elements and then set in the coater machine as an integral device. Each die element is comprised typically of a manifold 19 and a more distal die section 21. The most distal portion of the die section is referred to as the die lip 29, described and illustrated in more detail in connection with FIG. 2. Since the die 20 is modular, various combinations of die lips 29 can be assembled without necessitating modifications to the other die sections and lips 29.

As illustrated by the horizontal arrow 28 in FIG. 1, the die 20 can be moved radially into or away from the back-up roll 26 in order to adjust the coating gap 30, which is defined as the distance between the die lips 29 and the web 22. In addition, the angle of attack ($\alpha$) of the die 20 can be adjusted, as shown by the arrow in FIG. 1.

The elements of the die 20 are separated from each other slightly by slots or feed gaps 32 which allow the coating material to flow from a manifold 19 in the die 20, through these feed gaps in the die 20, and onto the moving web 22. In the multilayer die 20 of FIG. 1, two feed gaps 32 are shown. However, as noted above, it will be understood that the principles of the present invention are equally applicable to a plurality of layers in addition to two.

Adjustment of Liquid Viscosities

As noted above, in one important aspect of the present invention, certain physical parameters of the liquids to be coated in multiple layers onto the substrate or web are analyzed with respect to the likelihood of achieving uniform film thicknesses in the cross-web direction. Of these parameters, perhaps the most important is the liquid's viscosity. More specifically, it will be understood that the ratio of viscosities of the two contiguous layers to be coated must be carefully analyzed and, in accordance with the present method, adjusted to a value within the optimal range or which provides an improved viscosity match between the two layers.

For example, it has been observed that if the viscosity of the top layer liquid is in the range of 50% less than to 100% more than the viscosity of the bottom layer liquid better coating results are likely, although other ratios may also provide good coating results if other parameters are optimized. Optimally, the viscosity of the top layer should be about 30% greater than that of the bottom layers. Viscosity ratios in this range provide a more stable flow. More specifically, a higher top layer viscosity reduces the risk of cross-web defects termed "inter-layer ribbing", in which the top and bottom layers alternate with one another across the web rather than forming two uniform films, one on top of the other.

It will be understood that the relative viscosities of the liquids to be coated are determined in large part by the nature of the multilayer product to be produced. That is, adjustments to viscosity in one liquid or the other may not be possible or practical depending on cost, supply, delivery or other variables. However, to some degree, the viscosities of the liquids may be "matched" in order to achieve favorable coating conditions. For example, if greater flow stability is desired, it may be possible to increase the viscosity of the top liquid by adding thickeners. Likewise, the viscosity of the bottom layer may be reduced by adding thinners, such as water, solvent, etc. On the other hand, such thinning agents, and especially, solvents, generate other problems such as environmental concerns, increased drying time, etc. Furthermore, any adjustments to viscosity must only be approached with the goal of maintaining the adhesive properties for which the liquid was selected in the first place. If these properties are destroyed or even diluted, the end product may be worthless even though coatability was high.

In one aspect of the present method, temperature can be used to adjust the viscosity of the liquid to improve coatability while maintaining product characteristics. Thus, with reference to FIG. 2*a*, a viscosity versus shear rate graph is illustrated in which a top layer X is proposed to be coated over a bottom layer Y, where the temperature of X is varied over a range of 150 degrees Centigrade to 180 degrees Centigrade. In this graph, shear rates are displayed over a range of 1000 to 100,000 reciprocal seconds (1/sec) and viscosity is expressed in Pascal-seconds (Pas). It will be noted that the bottom layer Y is held at a constant temperature 170° C. for purposes of this example.

Figure 2A:
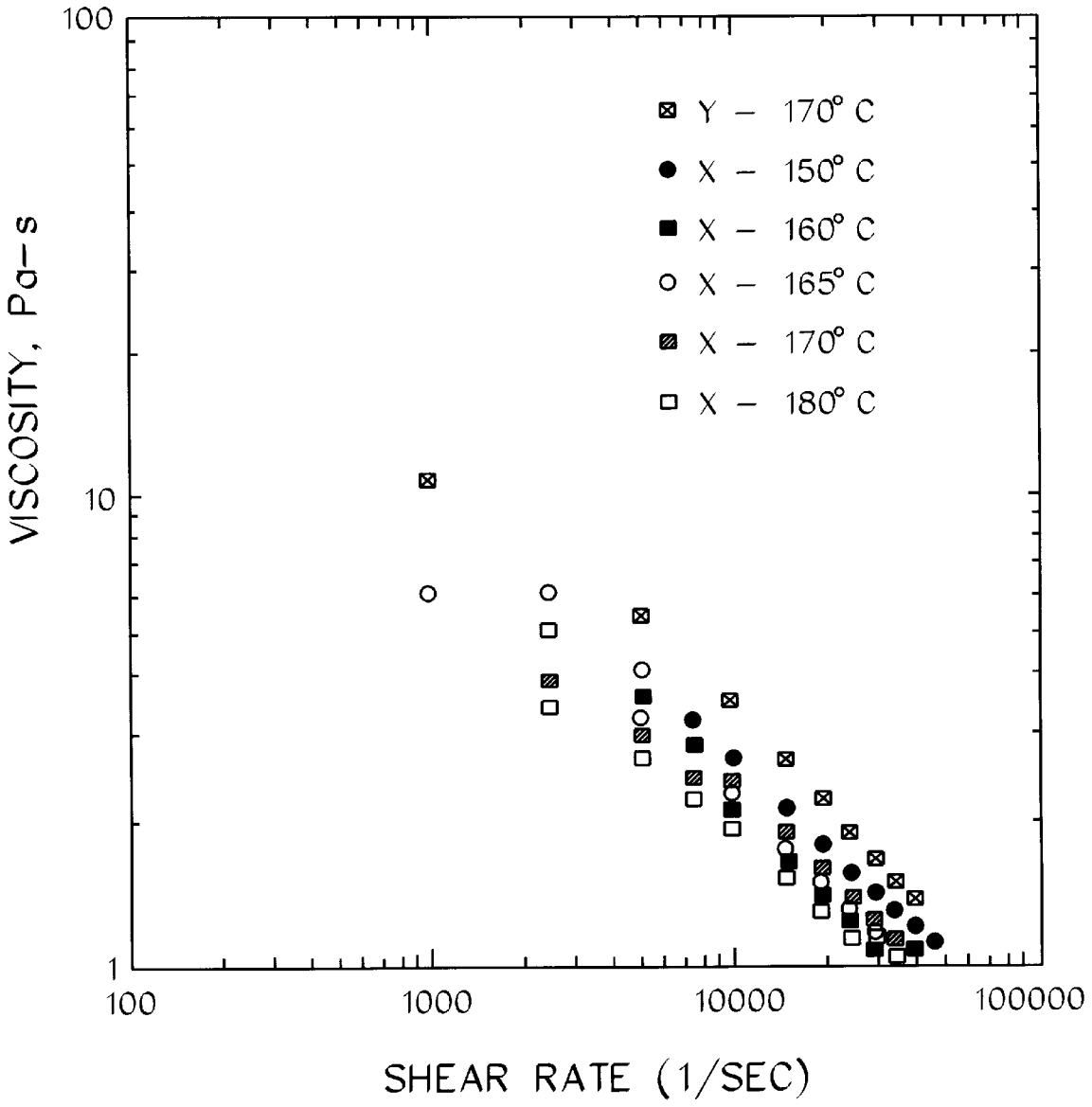
FIG. 2*a* is a graph of viscosity versus shear rate for two sample liquids, the temperature of the bottom layer being varied to illustrate the adjustment of viscosity to better match that of the top layer.
Figure 2B:
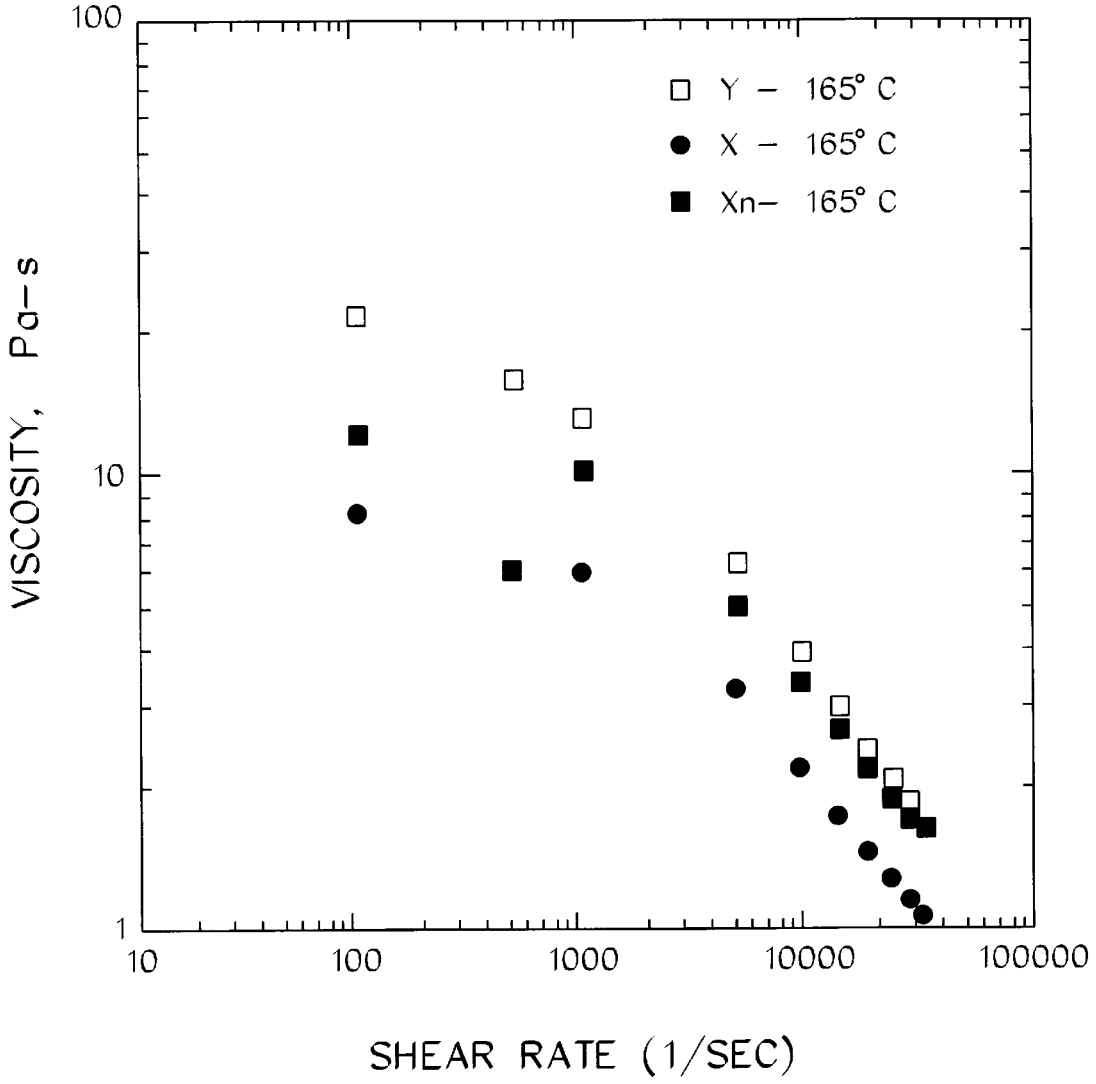
FIG. 2*b* is a graph of viscosity versus shear rate for the same two sample liquids of FIG. 2*a* at 165° C., and further illustrating a third liquid whose viscosity is adjusted through reformulation in order to achieve enhanced coatability through a combination of viscosity adjustments.

FIG. 2*a* illustrates an inverse coating relationship in which the viscosity of the top layer is less than that of the bottom layer. When the two adhesives are held at the same temperature 170° C.), this difference in viscosity is substantial. However, as illustrated in the graph, as the temperature of the top layer X is decreased, its viscosity increases, thus approaching that of the top layer Y. Although even at 150° C. the inverse coating conditions are not eliminated, they are minimized. Furthermore, if the bottom layer Y could be coated at a slightly higher temperature, such as 175° C., the coating conditions would be even better since the viscosity of Y would decrease, thus further approaching the viscosity of X.

Thus, FIG. 2*a* illustrates the manner in which the viscosity of one or more of the coating liquids can be adjusted by the use of temperature differential variations. This technique results in improved coatability as illustrated in the table below.

TABLE 1

| | Adhesives | | Temp. (° C.) | | Coat Weight ($gm/m^2$) | | Nom. Dwnstrm. Step | Line Speed | | Quality Ranking |
|---|---|---|---|---|---|---|---|---|---|---|
| Sample | Top | Bottom | Top | Bottom | Top | Bottom | (in.) | (ft/min) | Defect | (1–10) |
| A1 | X | Y | 160 | 160 | 10 | 10 | .001 | 50 | Banding, striations | 1 |
| A2 | X | Y | 150 | 170 | 10 | 10 | .001 | 50 | Fewer bands, striations | 2 |
| B4A1 | X | Y | 160 | 160 | 10 | 10 | .002 | 50 | Wide bands | 1 |
| B4A2 | X | Y | 150 | 170 | 10 | 10 | .002 | 50 | Striations, chatter | 4 |
| B6A2 | X | Y | 150 | 170 | 8 | 12 | .002 | 50 | Striations, chatter, some bands | 4 |
| B5A3 | $X_D$ | Y | 160 | 160 | 10 | 10 | .002 | 100 | Striations | 8 |

This table displays the results of several coating samples utilizing the principles of the present method. That is, in these sets of examples, all coating parameters were held constant except adhesive temperature. With the appropriate viscosity adjustments via temperature differential, coating quality improved. Thus, in the first sample set, comprising samples A1 and A2, the same two adhesives were coated under constant coating conditions, except that in the second sample (A2), the temperature of the top layer X was decreased to 150° C. and that of the bottom layer Y was increased to 170° C. This condition is, in fact, illustrated in FIG. 2*a*. Thus, it will be observed from the table that the quality of the coating improved from a rank of 1 to a rank of 2 (10 being highest quality); although, some banding still occurred. As noted above, banding is a defect in which the adhesive is not coated in a uniform layer across the web.

Thus, in the second sample set (B4A1 and B4A2), even the banding was eliminated. In this example, in addition to a temperature differential, the nominal downstream lip step was increased to about 0.002 inches. This produced a large jump in coating quality, from a ranking of 1 to 4. It will be noted that the step dimension is nominal because of the temperature effects on the geometry of the die. This improved coatability was even maintained in sample B4A3 wherein the coat weight or thickness of the top layer was decreased to 8 gm/m2 and that of the bottom layer increased to 12 gm/m2. Normally, a thinner top layer presents greater difficulties due to weaker stability in the flow. However, despite these challenges, a quality ranking of 4 was maintained due to the temperature differential.

A third sample (B5A3) illustrates the advantages of adjusting viscosity through reformulation of the liquid. In this sample, a re-formulation (Xn) of the top adhesive (X) results in a higher viscosity, better matched liquid. The results are substantial. The coating of the combination of Xn and Y yields a quality ranking of 8, all other parameters being essentially the same as in sample B4A2. This result could have been predicted from FIG. 2*b* which illustrates this relationship graphically. The units on this graph are the same as FIG. 2*a*. Thus, it will be readily observed that the viscosity of Xn is almost the same as Y, yielding a much better matched adhesive pair than X and Y.

Moreover, under appropriate circumstances, a combination of viscosity adjustments, due for example to temperature differential and/or reformulation, can be utilized to improve coating conditions. Typically, in order to stay within the property limits of the materials being coated, these adjustments represent fine tuning of the coatability of the materials. Nevertheless, as described above and illustrated in the figures, they can have a substantial impact on quality.

Effect of Shear Rate on Viscosity

In analyzing viscosities, however, one must consider the shear rates experienced by the particular liquid under typical coating conditions. Such shear rates vary by several orders of magnitude, but typically exceed 1000 reciprocal seconds (1/sec) at most locations along the bead. Thus, at these shear rates, the relative viscosity of the liquids can vary widely.

Figure 2C:
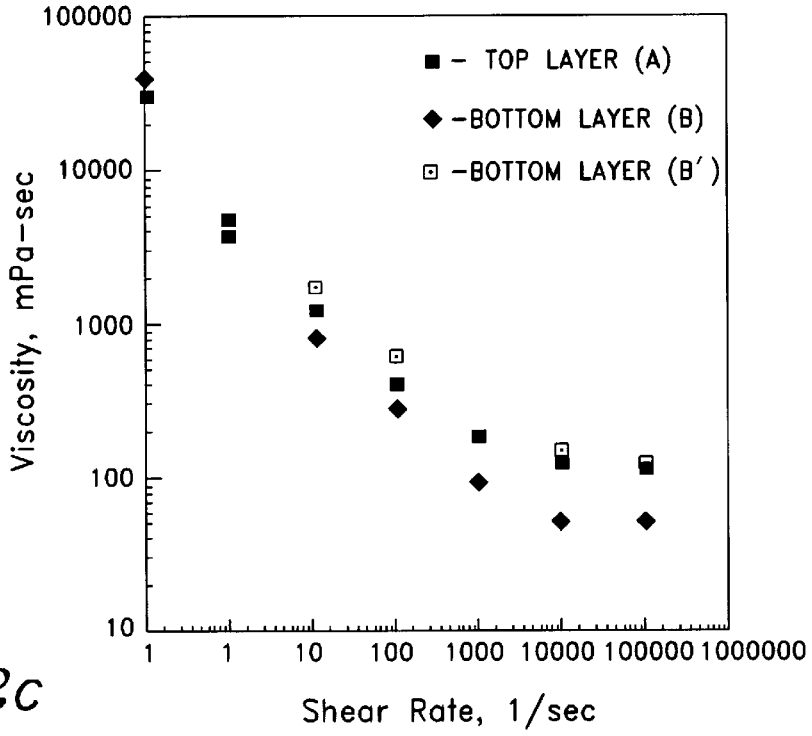
FIG. 2*c* is a graph of viscosity versus shear rate for three sample liquids to be coated onto a web in accordance with the present method illustrating the effects of shear rate on viscosity.

FIG. 2 illustrates a shear rate/viscosity graph in which it is proposed that a top layer A be coated over a second liquid formulated at two different viscosities (B and B'), where B' is greater than B. In this graph, shear rates are displayed over a range from 0.1 to 100,000 1/sec; although, the area of analysis is at shear rates above about 1000 1/sec. It will be noted that the ratio of viscosities between layer A and layer B changes significantly at higher shear rates as compared to lower shear rates. Furthermore, based on the foregoing analysis, one would assume that the combination of liquid A over liquid B would coat well since the viscosity of A is greater than that of B. Indeed, successful coating was achieved experimentally, but initially only at lower web speeds. At higher web speeds, the bead leaked upstream, a defective condition described in more detail below. The reason this condition occurred in the present example lies in the fluid mechanics of the flow and relates to the difficulty of a lower viscosity liquid (liquid B in this example) to generate enough pressure drop below the upstream lip to seal a bead which downstream is made up, in part, of a more viscous liquid (A). This illustrates the interaction of several principles which need to be considered in this liquid viscosity analysis. For example, this upstream leakage condition can be corrected in several possible ways. One involves the design of the lip geometries in accordance with principles of the present method described in more detail below. Another involves the adjustment of the relative viscosities of the two liquids.

For example, when liquids A/B' were coated experimentally, good coating results were obtained over a wide range of web speeds. This is because, as FIG. 2 graphically illustrates, the viscosities of the two liquids are balanced or better matched at high shear rates. For example, the viscosity of liquid B' is more than twice that of B. It must be noted, however, that the viscosity of B' did not substantially exceed the viscosity of the top layer A.

Figure 3:
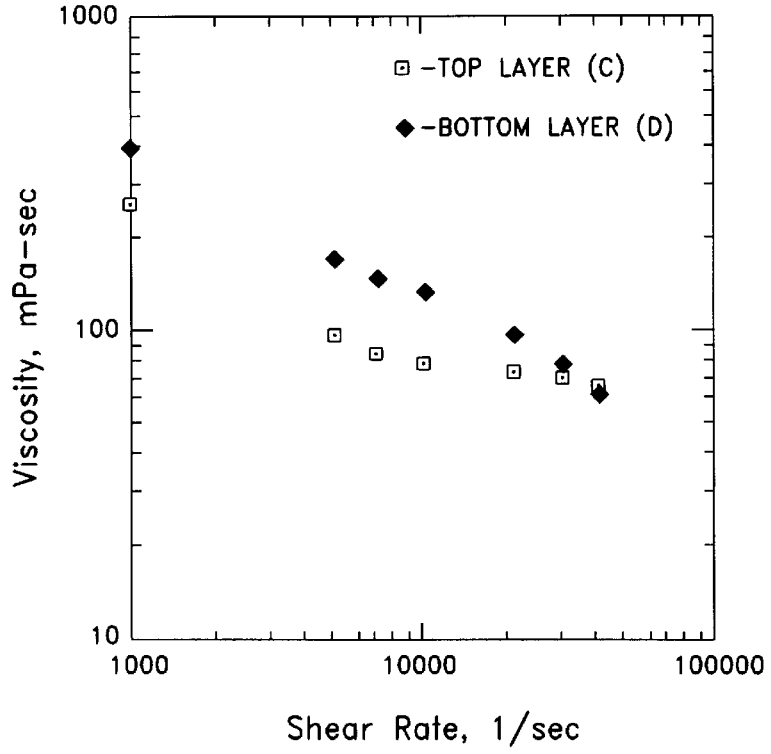
FIG. 3 is a second graph of viscosity versus shear rate for different sample liquids to be coated.

This condition is illustrated in FIG. 3 which illustrates a shear rate versus viscosity graph for two sample liquids C and D. In this example, liquid C is to be coated on top of liquid D. In this graph, only the high shear rate viscosities need be analyzed. Thus, it will be observed from FIG. 3 that, for most of the typical shear rate range, the viscosity of the bottom layer D exceeds that of the top layer C . Under these inverse viscosity conditions, it has been found that it is difficult to achieve stable coating, and, although multilayer coating may be possible, it is difficult to achieve high quality. Under proper viscosity conditions, the coating window for a particular operation will be larger, thus increasing the likelihood of stable flow.

It will be appreciated, by those of ordinary skill, that a wide variety of viscosity relationships will be encountered in producing a particular multilayered product. Thus, the foregoing examples are not to be considered exhaustive of the scope of the liquid analysis encompassed within the steps of the present method.

Another aspect of liquid analysis involves the relative surface tensions of the liquids to be coated. It has been found that the risk of certain defects such as dewetting or voids, or voids in one particular layer, can be reduced if the surface tension of the top layer is less than that of the bottom layer. Under these conditions, the local surface tension (including the dynamic surface tension in the film forming region) will tend to close such voids. Surface tension can be reduced in the top layer, to some degree, by the use of effective surfactants or other organic soluble liquids (alcohol, ketone, etc.).

Thus, the liquid analysis aspect of the present method is important in achieving favorable coating conditions. The lip design and die set-up aspects of the method will be discussed together below; however, the following information relating to single layer coating will explain how those aspects of the present method assist in achieving stable flow.

Single-Layer Fluid Mechanics

In order to assist in understanding the advantages of the present method, it is important to understand the relationship between the coating gap 30, the downstream wet film thickness, and the liquid pressure gradient. This can best be illustrated and explained with respect to a single-layer coating process.

Thus, referring to FIG. 4, there is shown a close-up cross-sectional, schematic view taken through a pair of die lips 36 positioned adjacent to a moving web 22 to form a coating gap 30 ("c.g."). It will be noted with respect to FIG. 1 that the die 20 has been rotated clockwise approximately 90 degrees in order to facilitate this illustration. In addition, the web 22 is shown to be flat or horizonal, whereas it actually will exhibit some curvature as it conforms to the back-up roll (not shown). However, the configuration shown in FIG. 4 is a good approximation of the fluid mechanics occurring in the bead 42 of liquid formed in the coating gap 30 between the die lips 36 and the moving web 22.

For ease of reference, "downstream" will refer to the direction of web 22 travel, while "upstream" is in the opposite direction or to the left. Thus, the upstream lip 36*a* is formed on the distal-most tip of the upstream die section 38*a*, while the downstream lip 36*b* is formed on the distal-most tip of the downstream die section 38*b*. The two die sections 38*a,b* form between them a coating slot or feed gap 40 out of which the liquid flows onto the moving web 22. As shown in FIG. 4, the liquid first travels upstream and then turns to flow downstream in an open recirculation within the bead 42. The bead 42 is bounded on its upstream edge by an upstream meniscus 44 and on its downstream edge by a downstream meniscus 46 or film-forming region. If the fluid, due to extreme conditions, escapes the bead 42 and travels upstream, this is referred to as upstream leakage.

The coating gap 30 is shown as dimension A in FIG. 4. It will be understood, particularly with reference to subsequent drawings, that the coating gap 30 can vary along the longitudinal length of the lips 36 in accordance with different lip geometries, lip machining defects, angled or beveled lips, adjustments and angle of attack of the die, etc.

The wet film thickness (h) of the flow is shown downstream of the bead 42. It is defined as the thickness of the flow before drying. The pressure gradient of the flow at various longitudinal positions is related to the wet film thickness (f.t.) and to the coating gap 30 at that location, it being understood that for a given flow rate (Q) the film thickness and web velocity are inversely proportional. Thus, for a Newtonian liquid flowing at steady state, the velocity is given as follows:

$$u = \frac{\bar{u}y}{a} + \frac{a^2}{2\mu}\left(\frac{dp}{dx}\right)\left[\left(\frac{y}{a}\right)^2 - \left(\frac{y}{a}\right)\right]$$

where:

u=velocity of the liquid downstream;

$\bar{u}$=velocity of the web;

a=coating gap (c.g.);

h=wet film thickness (f.t.);

$\mu$=viscosity of the liquid;

x=horizontal coordinate in the downstream direction;

y=vertical coordinate going from lip to web; and dp/dx=pressure gradient in the downstream direction.

It will be noted from this equation that the velocity of the flow (u) is made up of two components. The first component may be characterized as a "drag driven" component, wherein the velocity of flow varies in direct proportion to the speed of the web. The second component may be referred to as a "pressure driven" component, such that the velocity of flow is proportional to the pressure gradient (dp/dx) at a given point. Using the definition of flow rate (Q), one integrate the above equation to solve for the pressure gradient, yielding:

$$\frac{dp}{dx} = \frac{12\mu}{a^3}\left(\frac{\bar{u}a}{2} - Q\right)$$

Since Q=h$\bar{u}$, the pressure gradient may be expressed in terms of the coating gap (a) and wet film thickness (h) as:

$$\frac{dp}{dx} = \frac{12\mu\bar{u}}{a^3}\left(\frac{a}{2} - h\right)$$

Thus where h=1/2a (or, in other words, the coating gap is twice the wet film thickness), dp/dx=0. Accordingly, in accordance with these well-known relationships, the velocity of the flow and the related pressure gradient at a particular point in the bead can be determined for a given coating gap/film thickness relationship. The velocity can be plotted as a velocity profile, such as those illustrated in the series of schematic illustrations comprising FIG. 5. In all cases described below, it will be noted that where y=0 (at the die lip), the velocity of flow (u) equals zero; but while y=a (at the web), the velocity of flow equals that of the web ($\bar{u}$).

FIG. 5*a* illustrates a coating condition wherein the coating gap 30 is exactly equal to twice the film thickness. In this condition the pressure in the liquid is constant, giving a pressure gradient of zero.

However, as noted above, coating gap conditions can change due to a number of variables. Thus, FIG. 5*b* illustrates a condition where the coating gap 30 is less than two times the downstream film thickness. Under these circumstances the velocity profile is concave in the downstream direction, thus exhibiting a negative pressure gradient. This negative pressure gradient produces a pressure drop along the downstream lip 36*b* in the downstream direction. The pressures in the upstream regions are higher, thus adding to the velocity characteristics of the liquid and causing it to push forward or bulge the velocity profile, as shown in FIG. 5*b*.

On the other hand, FIG. 5*c* illustrates the situation where the coating gap 30 is equal to three times the film thickness (h). Under these conditions the downstream pressure gradient is greater than zero, meaning that the flow sees an increasing pressure downstream. This increase in pressure has a tendency to diminish the velocity, making the velocity profile convex in the downstream direction.

Finally, FIG. 5*d* illustrates the condition when the coating gap 30 is greater than three times the film thickness (h). Again, the pressure gradient is positive, but more so than that shown in FIG. 5*c*. Thus, an even greater downstream pressure is seen, actually causing the flow to travel upstream a short distance before it turns and travels downstream. This condition illustrates the principal cause for recirculation in the liquid. This recirculation can occur under the upstream lip 36*a*, as shown in FIG. 4, but may also occur under the downstream lip 36*b* if the coating gap 30 is too great, as illustrated in FIG. 5*d*.

This recirculation, while not particularly damaging to the quality of the film in single layer coating, can have disastrous effects in multilayer coating. It has been found that such conditions can be substantially avoided with correct lip design and proper die assembly and set-up. Because of their interrelationship, these aspects of the present method are discussed together below.

Lip Design and Die Set-Up

The method of the present invention controls the pressure gradients in the liquids under a wide variety of coating conditions in order to achieve a stable flow. This is accomplished in large part by the design of the lip geometries and the assembly, set-up, and adjustment of the die.

Figure 6:
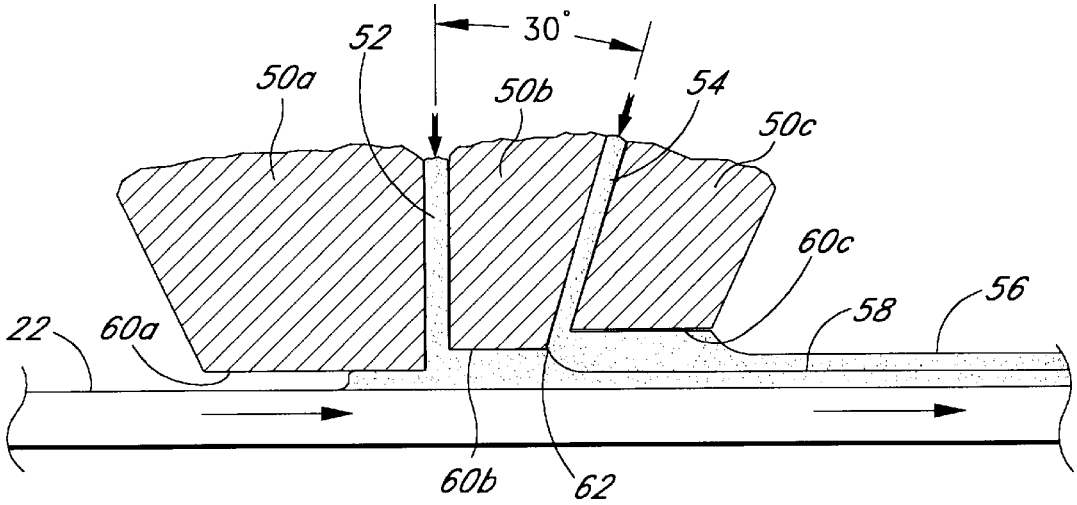
FIG. 6 is a close-up cross-sectional view of the coating gap of the multilayer die shown in FIG. 1, further illustrating the adjustment of the various coating parameters in accordance with the method of the present invention.

Thus, referring to FIG. 6, there is shown a close-up cross-sectional view of a multilayer die 20 which may be utilized with the method of the present invention. The present method can be utilized in accordance with dies and other coating techniques well known to those of ordinary skill in the art to produce successful multilayer products. In addition, the present method can be utilized in accordance with a novel multilayer die described and claimed in copending application Ser. No. 08/483,509, filed Jun. 7, 1995, and hereby incorporated by this reference.

Although similar to FIG. 4, this die 20 is comprised of upstream and downstream die sections 50*a* and 50*c*, as well as a middle section 50*b* separating the two. Formed between these various sections are an upstream feed gap 52 and a downstream feed gap 54. The liquid from the upstream feed gap 52 flows onto the web 22 to form a bottom layer 58, while the liquid from the downstream feed gap 54 flows onto the bottom layer to form a top layer 56. It will be noted that the angle formed between these two feed gaps 52, 54 is approximately 30 degrees, which advantageously provides a good construction for the machining of a middle lip 60*b* formed on the distal end of the middle land 50*b*. It will also be noted from FIG. 6 that the lips 60*a* and 60*c* of the upstream and downstream die sections 50*a,c* form a stepped or staircase configuration with respect to the middle lip 60*b* in order to regulate the pressure gradient in this region. The importance of this relationship will be described and illustrated in more detail in connection with FIG. 5.

It will be noted in FIG. 6 that this stepped lip configuration results in various coating gaps. For ease of reference, the subscript b will refer to the bottom layer 58 while the subscript t will refer to the top layer 56. Thus, the coating gap of the bottom layer ($C.g._b$) is characterized by two different values, one under the upstream lip 60*a* and one under the middle lip 60*b*. The coating gap of the top layer ($c.g._t$) is characterized by a larger value. As noted above, these coating gaps bear important relationships to the downstream film thickness of the respective flows which are formed thereby. Thus, for example, the bottom coating gap bears an important relationship in terms of pressure gradient with the downstream film thickness of the bottom layer 58 ($f.t._b$), while the coating gap of the top layer 56 bears an important relationship with the total downstream film thickness ($f.t._t$) (it is perhaps helpful to note that the subscript t may refer not only to the top layer, but also to the "total" thickness of the downstream film) which includes the sum of the bottom and top layers. This is because the coating gap analysis, in determining pressure gradient, must be based on the total flow at that gap, including the flow approaching the web 22 at that position as well as all previous flows and layers resulting therefrom.

It will be further noted from FIG. 6 that the bottom coating gap is less than the top coating gap in order to form the "step" described above. This step in the middle lip 60*b* with respect to the downstream lip 60*c* occurs in a very important interface area where the two flows converge at the downstream feed gap 54. Thus, an important aspect of the present invention is a design process which results in particular middle lip 60*b* and downstream lip 60*c* geometries, including the length of each lip in this region. These are also described in more detail below in connection with FIG. 7.

Finally, it will be noted in FIG. 6 that the lips 60 are each parallel to each other or, in other words, lie in parallel planes. However, the principles of the present invention are not limited to such design considerations. For example, the lips 60 can be angled or beveled with respect to one another, as described below and illustrated in more detail in connection with FIG. 7. In addition, a wide variety of other lip geometries and other methods for affecting the pressure gradient are within the principles of the present invention.

Figure 7:
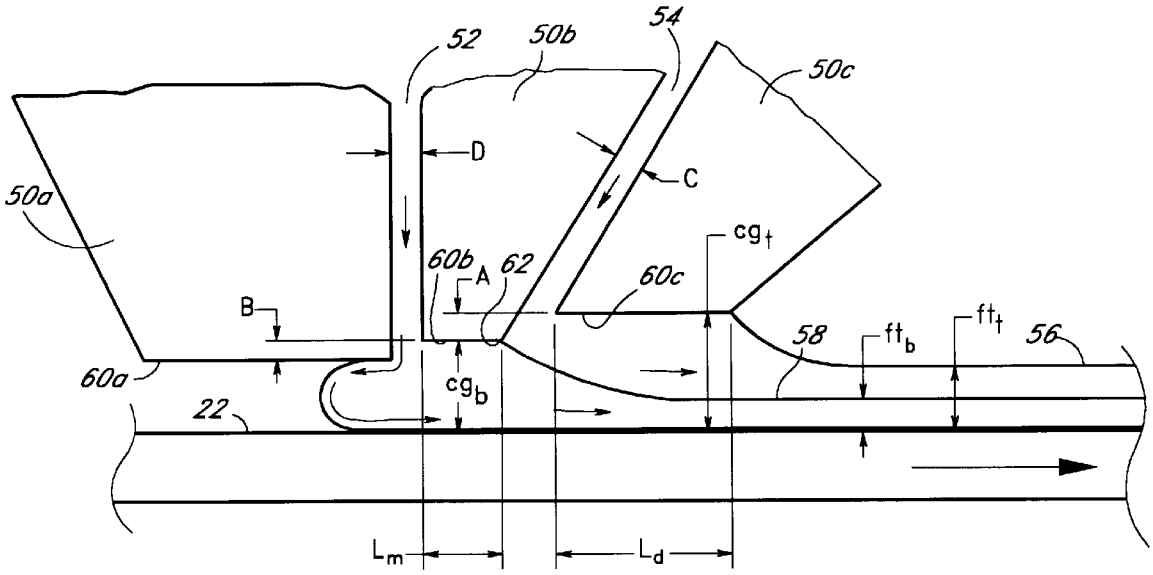
FIG. 7 is a close-up cross-sectional view of the interface region of the coating gap shown in FIG. 6 illustrating in more detail the relationship between lip geometries and the coating gap adjustment steps of the present method.

Referring to FIG. 7, there is shown a close-up view of the interface region, as illustrated more generally in FIG. 4. This drawing illustrates the complete interface between the top layer flow 56 from the bottom layer flow 58. The flow of each layer, as well as its respective direction, is shown by a series of arrows. Thus, the two layers are shown exhibiting steady, two-dimensional flow with the separating streamline optimally positioned at the stability point. This results in uniform layers in terms of cross web and down web cross-sectional thickness. This type of stable, two-dimensional flow results in good multilayer product performance.

As noted above, in order to achieve such stable flow, it is important to avoid mixing between the two layers. This can be achieved, in one aspect of the present invention, by accurate control of the separating line of the two fluids. As shown in FIG. 7, best coating results are achieved when this separating line coincides with the downstream corner 62 of the middle lip 60*b*, referred to as the stability point. The present invention comprises a method for regulating pressure gradients in the flow to fix or lock the separating line of the top flow at this stability point 62. Preferably, the pressure gradient under the middle lip 60*b* (and in particular the downstream corner 62 of the middle lip 60*b*) is not greater than the pressure gradient which would cause recirculation under the middle lip. Thus, the flow of the top layer does not have a tendency to invade the bottom layer coating gap in the upstream direction. This pressure situation tends to fix the separating line at the stability point 62 under the downstream lip.

As noted above, this advantage is achieved in one aspect of the present invention by stepping the die lips away from the web 22 in the downstream direction. This step is shown as dimension A in FIG. 7. The magnitude of this step may fall within a wide range of dimensions which may be optimized for a given set of coating conditions. However, preferably, this distance A will fall in the range of 0–0.004 inches.

Figure 8:
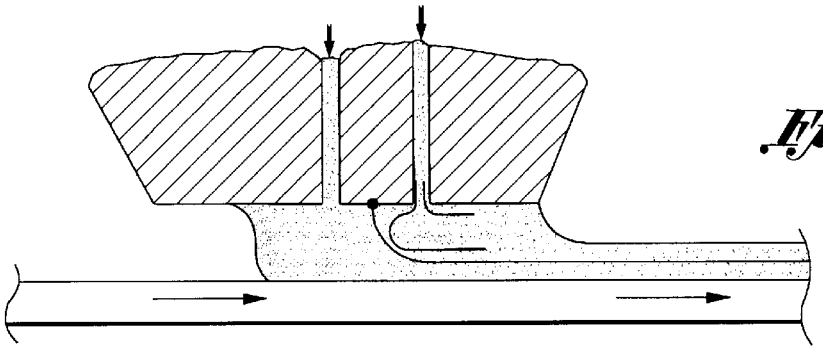
FIG. 8 is a schematic illustration of the recirculation that may occur in the bottom layer liquid if the steps of the present method are not followed.

At the same time, however, as noted above, in order to achieve the advantages of the present invention, these lips must be appropriately positioned with respect to the web 22 in order to achieve the proper coating gaps. For example, if the bottom coating gap ($C.g._b$) is greater than three times the film thickness ($f.t._b$), a large pressure gradient will be developed just upstream of the interface area, as illustrated in FIG. 5*d*. Thus, a negative velocity profile may occur, causing recirculation in the bottom layer under the middle lip 60*b*. This recirculation may have the effect of pulling the top layer upstream and away from the stability point 62. This condition is illustrated in FIG. 8, and has all the disadvantages described above. On the other hand, if the bottom coating gap is a substantial amount less than two times the film thickness ($f.t._b$), although the desirable negative pressure gradient will be generated, it may be too high, thus resulting in upstream leakage, high shear rates, etc. Thus, preferably, the bottom coating gap should be maintained at approximately two times the film thickness.

Figure 9:
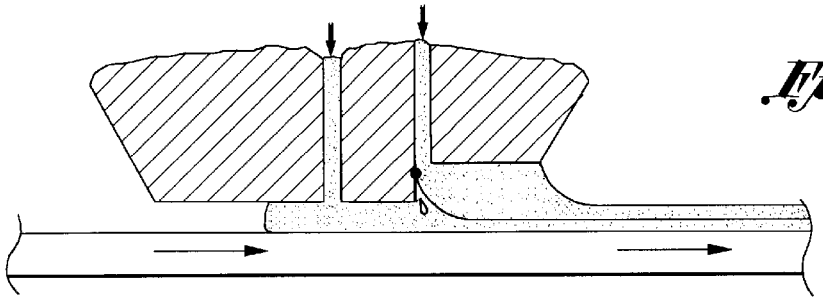
FIG. 9 is a schematic illustration of a vortex that may be formed in the bottom layer liquid if the steps of the present method are not followed.
Figure 10:
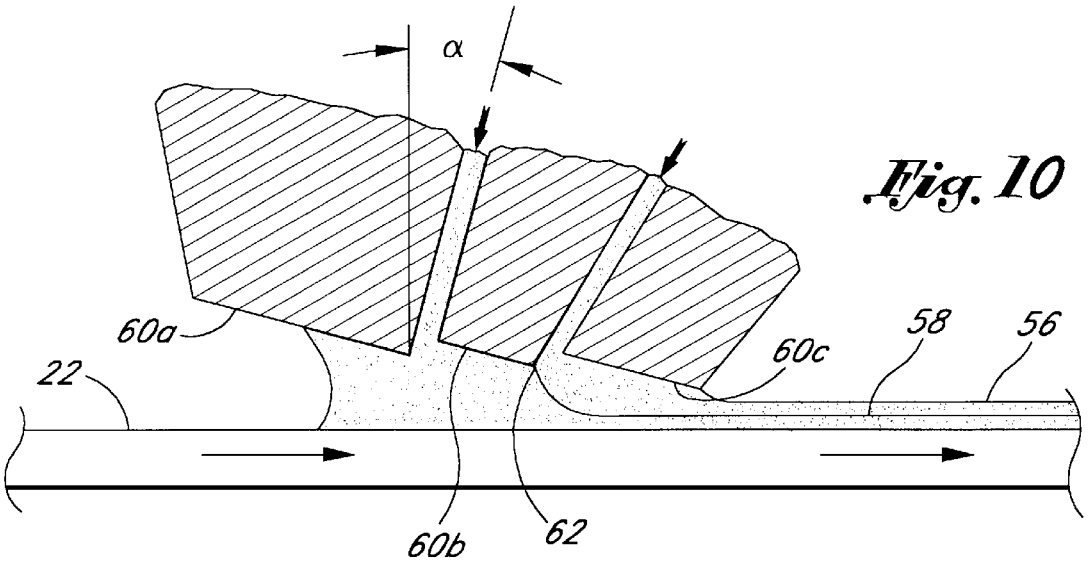
FIG. 10 is a close-up cross-sectional view of the multilayer die of FIG. 7, illustrating the step of adjusting the die with a negative angle of attack with respect to the web.

In addition, the coating gap under the downstream lip 60*c* ($c.g._t$) should be in the range of one to two times the total film thickness ($f.t._t$). Again, if it is too great, the pressure gradient under the downstream lip may be sufficiently large to cause the separating line to move up into the downstream feed gap and to separate from the middle die at a point on the upstream wall of such feed gap, as illustrated in FIG. 9. This flow condition causes a closed recirculation in the bottom layer flow and results in film defects. Thus, there are a number of trade-offs which require careful balancing of these parameters in order to achieve accurate pressure gradient control.

Referring again to FIG. 7, it will be noted that the upstream lip 60*a* is also stepped toward the web 22 with respect to the middle lip 60*b*. This also has the result of decreasing the coating gap and increasing the pressure gradient upstream. This situation will assist in sealing the bead 42 under the die lips. In fact, this coating gap is dictated by the following rationales. The pressure drop developed along this region must match the pressure drop through the liquid along the downstream portion of the flow, plus any differential pressure imposed by the ambient air surrounding the liquid at its downstream and at its upstream interfaces. Thus, the coating gap under the upstream lip 60*a* can be used to balance these pressure forces. It has been found that a slight step (illustrated as dimension B in FIG. 7) on the order of 0–0.004 inches is suitable.

Figure 13:
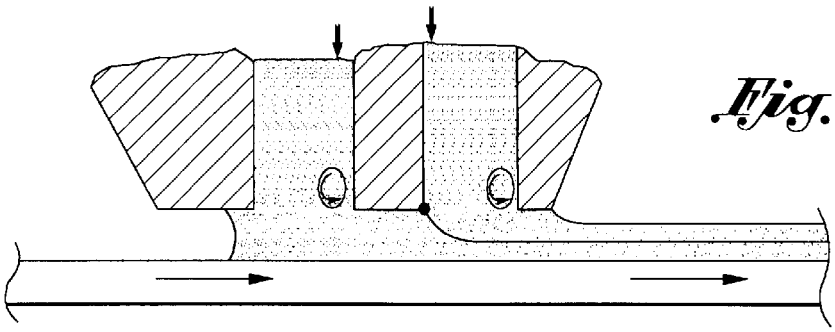
FIG. 13 is a schematic view of the recirculations that may occur in the feed gaps if they are not properly sized in accordance with the present method.

Moreover, because of the sensitivity of this process, it will be appreciated that the total step between the upstream lip 60*a* and the downstream lip 60*c* (i.e., A+B) should also be carefully regulated. Thus, it has been found that total steps in the range of 0–0.008 inches are advantageous. In addition, the feed gap dimension should also be carefully maintained to be about not more than five times the wet film thickness of the film being fed through that gap. If this gap is excessive, recirculations can occur in the feed gap, as illustrated in FIG. 13. Thus, these dimensions (C and D in FIG. 7) can each vary in the range of 0.001–0.015 inches.

Another important aspect of the present invention which assists in maintaining proper coating gaps and minimizing shear rates is the length of the lips. As shown in FIG. 7, the length of the downstream lip 60*c* ($L_d$) may be anywhere in the range of 0.1–3 millimeters, with about 0.8–1.2 millimeters being preferable. However, the length of this lip should be minimized so as to reduce the shearing of the multilayer film, which could lead to three-dimensional flows and uneven film formation. The length of the middle lip 60*b* ($L_m$) can also fall within the range of 0.1–3 millimeters, with about 0.3–0.7 millimeters being preferable. The length of this lip should be minimized so as to reduce the possibility that the upstream portion, when subject to changes in die angle of attack, will approach a coating gap of three times the film thickness. However, the lip must be long enough to allow the bottom layer flow to develop into a rectilinear flow. Finally, the upstream lip 60*a* length is less critical, since there is minimal flow along that lip. However, an increased lip length in this region will assist in sealing the flow.

Figure 11:
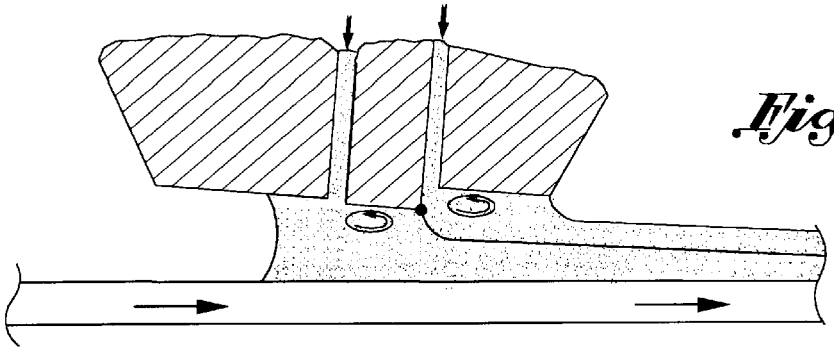
FIG. 11 is a schematic illustration of the recirculations that may occur under the die lips when the angle of attack adjustment shown in FIG. 10 results in excessively large coating gaps at the upstream portions of the lips.

As mentioned, it is well known to place a slight negative angle of attack of the die 20 with respect to the web 22 in order to produce a converging downstream lip 60*c*. Thus, FIG. 6 illustrates the multilayer die 20 of the present invention turned clockwise at a negative angle of attack ($\alpha$) with respect to the web 22. Thus, angles of attack in the range of zero to negative 5 degrees have been found to be appropriate for this purpose. It will also be appreciated that this angle of attack changes the coating gap at the upstream edge of all of the lips, thus affecting the performance of the pressure gradient regulator of the present invention. Thus, even if the coating gap at the downstream edges remains the same at its appropriate dimension, depending upon the length of the lips and taking into consideration the curvature of the roll 26, the coating gap at the upstream edges of the lips may exceed the desired value and bring the operation outside the coating window. Thus, the longer the lips and the greater the negative angle of attack, the more likely it is for coating conditions to fall outside the operating window. This situation is illustrated in FIG. 11, which illustrates recirculations under both the middle and downstream lips.

Figure 12:
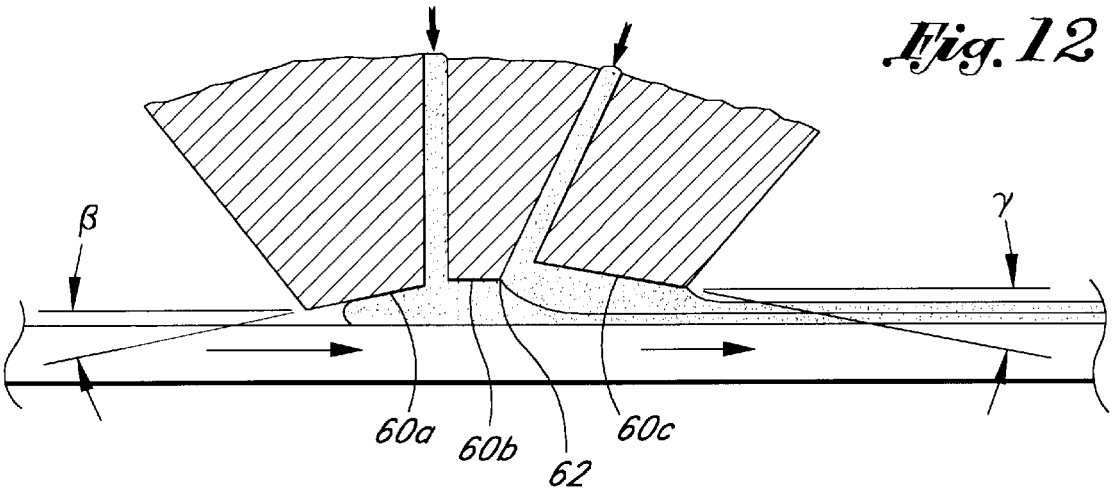
FIG. 12 is a close-up cross-sectional view illustrating the step of the present method of beveling the upstream and downstream lips.

Accordingly, in another aspect of the present invention the upstream and the downstream lips of the die 20 may be beveled in order to minimize these effects. Thus, for example, if the downstream lip 60*c* is beveled by an angle $\gamma$, as shown in FIG. 12, then the need to rotate the die 20 to a negative angle of attack is possibly eliminated. This allows greater control in the coating gap ($c.g._t$) along this downstream die lip. Likewise, with a convergent beveled downstream lip 60*c*, the middle lip 60*b* can be maintained preferably flat, as illustrated. Again, the coating gap under this important middle lip 60*b* ($c.g._b$) can be carefully controlled in the absence of angle of attack adjustment. That is, it is much less likely for the coating gap ($c.g._b$) to exceed three times the film thickness ($f.t._b$), especially at the upstream edges of the middle lip 60*b*. However, it should still be noted that the step between the middle and downstream lips, as discussed above in connection with FIG. 7, still exists.

Likewise, certain advantages can be achieved by beveling the upstream lip 60*a* in a diverging manner by an angle $\beta$, as shown in FIG. 7. This divergent angle can be used to seal the bead 42 and adjust pressure drop across the bead. Thus, it has been found that downstream lip 60*c* bevels in the range of 0–5 degrees are appropriate, while upstream lip 60*a* bevels in the range of 0–2 degrees are preferable. As noted, these bevels improve the optimization of the coating process, increase the size of the operating window, and reduce the precision which would otherwise be required in coating.

Design Process

In designing the lip geometries for a given set of coating and liquid parameters, any particular sequence of analysis or calculation is possible. One approach is to begin with the downstream lip and move upstream, calculating each coating gap and lip length in the process.

To begin, the wet film thicknesses for the various layers must be determined. Typically, the dry film thickness for each layer is obtained from product specifications in terms of coat weight (such as grams per square meter), and the solid fraction (the percentage of solids in the liquid), the density and viscosity of the liquid formulation to be coated are known. Thus, to arrive at wet film thickness, the coat weight is divided by the product of the solid fraction and the density. This number can then be used, in accordance with the ranges and dimensions set forth above, to compute all coating and feed gaps in the die. The lip lengths and angles of bevel (or angle or attack) may also be computed in accordance with the present method to optimize the coating operation.

Beginning at the downstream edge of the downstream lip, the coating gap may be set at one time the total wet film thickness. At this value, the sufficiently negative pressure gradient in the sense of the web travel should be achieved such that smooth film surface characteristics are achieved. As discussed above, the length of this lip is then designed. Whether the lip is to be beveled or a whether a negative angle of attack is applied to the die, this lip should be convergent in the direction of web travel. With the angle and length of the downstream lip known, the coating gap at the upstream portion of that lip can be calculated so as to ensure that it falls within acceptable ranges.

In designing the downstream lip, some consideration should be given to the issue of angle of attack versus beveling. As noted above, beveling is usually advantageous since it virtually eliminates the negative trade-offs associated with angles of attack. However, beveled lips are more difficult to machine than flat lips; thus, there is some sacrifice in accuracy. There are also increased cost considerations.

Turning to the middle lip, the coating gap at the downstream region is critical, as explained above. It should be maintained at around two times the bottom-layer film thickness, and should not be so excessively positive as to cause recirculation under that lip. The length of this lip should be minimized to reduce the likelihood of developing an excessively positive coating gap whenever an angle of attack is applied to the die, but not to the extent that a rectilinear flow cannot develop.

The design of the upstream lip is dictated by pressure drop considerations along the bead. Any design adequate to seal the bead is sufficient. A divergent bevel in the web direction is preferred since the pressure drop varies quadratically with distance along the bead. This means that the position of the upstream meniscus of the bead can be controlled more easily with respect to perturbations.

Once the length and angles of the lips have been determined and desirable coating gaps calculated, the die can be assembled from its various sections. This is accomplished in accordance with well known techniques, using shim stock, etc. At the same time, however, it is important that the steps of the lips relative to one another be correctly positioned. The feed gaps must also be formed by the correct positioning of the die lands. In order to avoid recirculation, the feed gaps should not be excessively wide. Lastly, the die can be set to an initial angle of attack, as determined by the foregoing computations or the development of a coating window, discussed below.

Coating Window

If considered necessary or desirable, ranges of various operating parameters for the die as thus designed and set-up can be determined. This is typically accomplished by experimentally coating the web using various samples of the liquids to be used in production, and by stepping through various angles of attack and coating gaps. Liquids of different viscosities may also be coated. The resulting information can be illustrated with a "coating window" indicating the parameter field within which good coating results are obtained.

Figure 14:
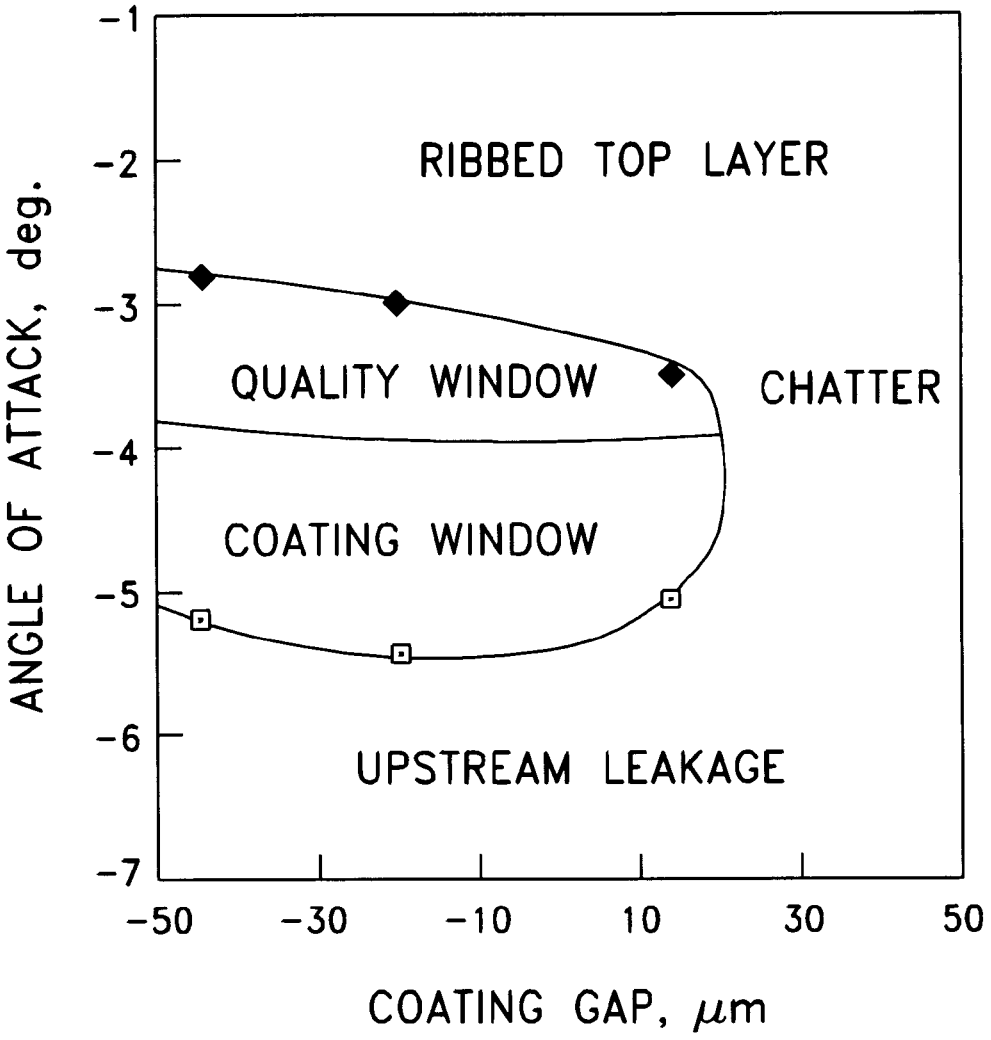
FIG. 14 is a graph of coating gap versus angle of attack illustrating the step of experimentally determining a successful coating window as well as the quality window for a particular set of coating parameters.

FIG. 14 illustrates a typical coating window for a multilayer construction to be coated at a given web speed. As shown, various points for coating gap and angle of attack are plotted to give the boundaries of the coating window. Outside of this window, the defects noted on the graph occurred. Thus, clearly, it is desirable to maintain the operation within the coating window.

It will be noted that more negative angles of attack usually result in lower downstream coating gaps due to the rotation of the die with respect to the web. For the graph of FIG. 14, a larger downstream coating gap is represented by an angle of attack which is less negative (less convergent in the direction of web travel). Thus, in accordance with another aspect of the present method, it is desirable to attempt to maintain the coating operation at those regions within the coating window where greater downstream lip coating gaps occur and where the angle of attack is just sufficient to avoid the ribbing defect. Operation in these regions will reduce elevated shear stresses that result in poor coating quality. However, at the same time, the coating gap must be sufficient to avoid recirculation below the middle lip.

These regions comprise a subset of the coating window which is referred to as the "quality window," and represents the area where coating quality is best. In addition, higher coating gaps (but not those that may result in excessively positive pressure gradients) are, in another way, desirable because they reduce the pressure drop along the bead and make it easier to seal at the upstream meniscus.

The trade-off here is a larger risk with respect to perturbations. That is, in the quality window, especially at a lower angle of attack, operation occurs near a defect boundary ("ribbing" in the example of FIG. 14). A perturbation may cause coating conditions, at least for some duration, to fall outside the coating window, thus resulting in a defective product. Thus, it is optimal to pick a point of operation which is in the quality window but far enough away from the defect boundary such that common perturbations will not cause operations to fall outside the coating window.

It will be appreciated by those of ordinary skill that coating windows comprising graphs of other parameters are possible. For example, it is common to graph web speed versus layer thickness ratio. Any combination of two or three relevant coating parameters may be graphed in order to determine a coating window and an inner quality window.

Trouble Shooting

During production, as just noted, perturbations or other irregularities may occur that introduce defects into the quality of the film. Thus, it is advantageous, in accordance with the method of the present invention, to be able to correct such defects as soon as possible, in order to minimize their degree and duration. If possible, such "trouble shooting" should occur during coating so that operations do not have to cease.

One of the more common defective conditions, as described above, is upstream leakage. If this occurs during operation, the coating gap may be increased to reduce the pressure drop along the bead. Alternatively, the elimination of upstream leakage may be accomplished by a change of die angle of attack which produces a higher downstream coating gap and a lower upstream coating gap (i.e., a less negative angle of attack). Other means, such as liquid viscosity adjustment, can be used to control upstream leakage.

Another defect is "de-wetting." If, in the film forming region, a perturbation affects the surface of the film, one or more layers may retract from the underlying layers or substrate leaving a void. This condition can be corrected by lowering the surface tension of the upper layers by, for example, increasing the surfactant in those layers. Also, the coating speed can be reduced in order to maintain the dynamic surface tension of the liquid of the film forming region at or below the stable level.

In conclusion, the method of the present invention represents a marked advancement in the multilayer coating art. It should be understood that the scope of the present invention is not to be limited by the illustrations or foregoing description thereof, but rather by the appended claims, and certain variations and modifications of this invention will suggest themselves to one of ordinary skill in the art.

What is claimed is:

1. A method of coating two or more liquid layers onto a moving substrate, said substrate having a substantially planar surface to be coated and an opposite surface, said method comprising the steps of:

providing a die for coating said liquid layers onto said substrate, said die having at least three lips formed thereon; said lips comprising, in the sense of direction of travel of said moving substrate, an upstream lip, a downstream lip, and a middle lip positioned between said upstream lip and said downstream lip; said die having an upstream feed gap separating said upstream lip and said middle lip and a downstream feed gap separating said middle lip and said downstream lip;

providing a support along one section of said moving substrate and positioning said support so as to be adjacent said opposite surface of said substrate;

positioning said die so as to be adjacent said moving substrate and opposite said support, said middle lip of said die being offset from said substrate to form a first coating gap, and said downstream lip of said die being offset from said substrate to form a second coating gap, each of said first and second coating gaps having a length as measured in the direction of travel of said moving substrate;

feeding a first flow of liquid through said upstream feed gap and said first coating gap and onto said substrate to form a first wet layer coating on said substrate;

feeding a second flow of liquid through said downstream feed gap and said second coating gap and onto said first flow of liquid to form a second wet layer coating on said substrate; the viscosity of said second flow of liquid within said second coating gap being about 50% less to 100% more than the viscosity of said first flow of liquid within said first coating gap;

adjusting said first coating gap such that, along said length of said first coating gap, the minimum coating gap is not less than two times the thickness of said first wet layer, and the maximum coating gap is not more than three times the thickness of said first wet layer; and adjusting said second coating gap such that, along said length of said second coating gap, the minimum coating gap is not less than the total thickness of said first and said second wet layers, and the maximum coating gap is not more than two times said total thickness.

2. The method according to claim 1, wherein the step of providing a die comprises providing a die wherein said lips lie in planes substantially parallel to one another, and form a stepped configuration such that said downstream lip is offset from said substrate by a distance greater than that of said middle lip, and said middle lip is offset from said substrate by a distance greater than said upstream lip.

3. The method according to claim 1, further comprising the step of adjusting said upstream lip to present a surface having a divergent angle in the sense of the direction of travel of said moving substrate of between approximately 0° and 2° relative to said substrate and adjusting said downstream lip to present a convergent surface having an angle of between about 0° and 5° relative to said substrate while maintaining said middle lip substantially horizontal to said substrate.

4. The method according to claim 1, wherein the step of providing a die comprises providing a die wherein said upstream feed gap is not greater than five times the thickness of said first wet layer and said downstream feed gap is not greater than five times the thickness of said second wet layer.

5. A method of coating two or more layers of liquids onto a moving substrate, comprising the steps of:

providing a die for coating said liquids onto said substrate, said die having an upstream lip, a downstream lip, and one or more middle lips positioned between the upstream and the downstream lips, said downstream lip being located downstream from said upstream lip in the sense of substrate travel; each of said middle lips having a length along the direction of substrate travel and being set back from said substrate to form a coating gap therebetween for coating one of said layers onto said substrate or onto a layer coated through another coating gap formed between one of said middle lips and said substrate;

adjusting viscosity of the liquid forming said one of said layers such that, within said coating gap, it is about 50% less to 100% more than viscosity of the liquid forming said layer coated through said another coating gap;

adjusting coating gaps formed between each of said middle lips and the substrate such that, along the length of said each of said middle lips, each of said coating gaps is not less than two times and not more than three times total downstream wet film thickness of layers coated through said each of said coating gaps and those coating gaps upstream to said each of said coating gaps; and feeding said liquid forming said one of said layers through one of said coating gaps and onto said substrate or onto said layer coated through said another coating gap formed between said one of said middle lips and said substrate.

6. The method of claim 5, wherein the step of adjusting the viscosity of said liquid forming said one of said layers comprises the step of adjusting the viscosity such that in said coating gap it is in the range from about the same to about 30% more than the viscosity of said liquid forming said contiguous previously coated layer.

7. The method of claim 5, wherein said downstream lip has a length along the direction of substrate travel and is set back from said substrate to form a coating gap therebetween for coating the last one of said layers onto a layer coated through a coating gap formed between a middle lip positioned upstream and adjacent to said downstream lip and the substrate, the method further comprising the step of adjusting the coating gap of said downstream lip such that, along the length of said downstream lip, the minimum coating gap is not less than the total thickness of all of said layers, and the maximum coating gap is not more than two times said total thickness.

8. The method of claim 5, wherein said viscosity adjusting step comprises the step of adjusting temperatures of the liquids forming said layers so as to generate temperature differential between any two contiguous layers.

9. The method of claim 8, wherein the top layer said layers is heated to a temperature of about 150°–180° C., respectively.

10. The method of claim 5, wherein said moving substrate moves at a line speed in the range of about 50–100 ft./min.

11. The method of claim 5, wherein said liquids are fed into said coating gaps at a shear rate in the range of about 1000–100,000 $Sec^{-1}$.

12. A method of manufacturing a multilayer product on a substrate by coating two or more layers of liquid onto said substrate, said coating process comprising the steps of:

providing a die for coating said layers onto said substrate, said die having at least an upstream lip, a downstream lip being located downstream from said upstream lip in the sense of substrate travel and one or more middle lips positioned between said upstream lip and said downstream lip, each of said middle lips having a length along a direction of substrate movement;

positioning each of said upstream, downstream, and middle lips on said die such that each of said lips is offset from said substrate to form a coating gap therebetween for coating one of said layers onto said substrate or onto layers previously coated thereon;

adjusting coating gaps formed between each of said middle lips and the substrate such that along the length of said each of said middle lips, each of said coating gaps is not less than two times of and not more than three times total downstream wet film thickness of layers coated through said each of said coating gaps and those coating gap upstream to said each of said coating gaps; and feeding each of said layers of liquid separately through each of said coating gaps onto said substrate or onto said previously coated layers to form said product.

13. The method of claim 12, further comprising the step of adjusting viscosity of liquid forming said one of said layers so as to be greater than that of liquid forming said layer coated through said another coating gap formed between said one of said middle lips and said substrate.

14. The method according to claim 12, further comprising the step of positioning the downstream lip such that the downstream lip is set back from said substrate to form a coating gap therebetween for coating a final layer onto said previously coated layers, and along the length of said lip, the minimum coating gap is not less than the total downstream wet film thickness of said final layer and said previously coated layers, and the maximum coating gap is not more than two times said total thickness.

15. The method according to claim 12, wherein one of said middle lips comprises a first lip and said downstream lip comprises a second lip, and said first and second lips lie in parallel planes.

16. The method according to claim 15, wherein the plane of said second lip is positioned further away from said substrate than the plane of said first lip.

17. The method according to claim 15, wherein said first and second lips lie in parallel planes separated by a distance ranging between about 0–0.008 inches.

18. The method according to claim 15, wherein said first and second lips are generally separated by the distal opening of a feed gap ranging between about 0.001–0.015 inches.

19. The method according to claim 15, wherein said upstream lip is offset toward said substrate with respect to said first lip.

20. The method according to claim 19, wherein said upstream lip is divergent with respect to said substrate in the direction of travel of said substrate, said plane of said first lip forming an angle between about 0°–2° with said substrate.

21. The method according to claim 19, wherein said first, second and upstream lips lie in substantially parallel planes, said planes of said first and upstream lips separated by a distance ranging between about 0–0.004 inches.

22. The method according to claim 19, wherein said upstream lip has a length ranging between about 1.5–2.5 mm.

23. The method of claim 19, wherein said first and second lips are generally separated by the distal opening of a first feed gap and said first and upstream lips are generally separated by the distal opening of a second feed gap, said first and second fed gaps forming planes converging in a distal direction toward said substrate by an angle of about 30°.

24. The method of claim 23, wherein said first and second feed gaps are adequate such that recirculation of said layers in said first and second feed gaps near said distal opening are substantially avoided.

25. The method according to claim 15, wherein said first lip has a length ranging between about 0.1–3 mm.

26. The method according to claim 25, wherein said first lip has a length ranging between about 0.8–1.2 mm.

27. The method of claim 15, wherein said first and upstream lips are generally separated by the distal opening of a feed gap, said die adapted to be positioned with respect to said substrate such that said feed gap forms an angle of attack measured positively in the direction opposite the substrate travel from a plane substantially normal to said substrate, said angle ranging between 0° to −5°.

28. The method of claim 12, wherein one of said middle lips comprises a first lip lying in a first plane, and said downstream lip comprises a second lip lying in a second plane, and the planes of said first and second lips intersect.

29. The method according to claim 28, wherein said second lip is convergent with respect to said substrate in the direction of travel of said substrate.

30. The method according to claim 29, wherein said plane of said second lip forms an angle between about 0°–5° with said substrate.

31. The method according to claim 12, wherein said second lip has a length ranging between about 0.1–3.0 mm.

32. The method according to claim 31, wherein said second lip has a length ranging between about 0.3–0.7 mm.

33. A method of adjusting the viscosity of two or more layers of liquid to be coated onto a substrate, said method comprising the steps of:

providing a die for coating said layers onto said substrate, said die having at least an upstream lip, a downstream lip being located downstream from said upstream lip in the sense of substrate travel, and one or more middle lips positioned between said upstream lip and said downstream lip;

positioning each of said middle lips on said die such that each of said middle lips is offset from said substrate to form a coating gap there between for coating one of said layers onto said substrate or onto layers previously coated thereon;

determining the viscosity of a first liquid being passed through a first one of said coating gaps, said first liquid forming said one layer;

determining the viscosity of a second liquid being passed through a second one of said coating gaps, said second liquid forming a contiguous one of said previously coated layers;

determining the shear rates experienced by said first and second liquids in said first and second coating gaps;

determining the viscosity of said first and second liquids at said shear rates;

adjusting the viscosity of said first and second liquids so that in said first and second coating gaps the viscosity of said first liquid is about 30% more than the viscosity of said second liquid.

* * * * *